US007871125B2

(12) United States Patent
Asbach et al.

(10) Patent No.: US 7,871,125 B2
(45) Date of Patent: Jan. 18, 2011

(54) INFANT SUPPORT WITH INDEPENDENTLY REPOSITIONABLE LEGS

(75) Inventors: Ronald M. Asbach, New York, NY (US); Maarten Van Huystee, New York, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 12/016,481

(22) Filed: Jan. 18, 2008

(65) Prior Publication Data

US 2008/0116723 A1 May 22, 2008

Related U.S. Application Data

(62) Division of application No. 10/835,267, filed on Apr. 30, 2004, now Pat. No. 7,328,941.

(51) Int. Cl.
*A47D 1/00* (2006.01)

(52) U.S. Cl. ..... 297/256.11; 297/344.18; 297/423.38

(58) Field of Classification Search ..... 297/256.11, 297/256.13, 338, 344.12, 344.18, 423.38, 297/168, 440.24; 248/564
See application file for complete search history.

(56) References Cited

U.S. PATENT DOCUMENTS

| | | | | |
|---|---|---|---|---|
| 436,642 | A * | 9/1890 | Towle | 297/168 |
| 848,391 | A | 3/1907 | Oliver | |
| 1,056,337 | A | 3/1913 | Hurlbut | |
| 1,135,269 | A | 4/1915 | Dudley | |
| 1,147,191 | A | 7/1915 | Rundle | |
| 1,163,628 | A | 12/1915 | Gibson | |
| 1,178,894 | A | 4/1916 | Wilcox | |
| 1,279,615 | A | 9/1918 | Van Meter | |
| 1,428,916 | A | 9/1922 | Snideman | |
| 1,429,249 | A * | 9/1922 | Parker | 248/600 |
| 1,526,920 | A * | 2/1925 | Liptak | 248/624 |
| 1,557,636 | A | 10/1925 | Warner | |
| 1,739,366 | A | 12/1929 | Lang | |
| 1,922,418 | A * | 8/1933 | Conant | 297/357 |
| 1,983,138 | A | 12/1934 | Lehman | |
| 2,240,602 | A | 5/1941 | Bartsch | |

(Continued)

FOREIGN PATENT DOCUMENTS

| | | |
|---|---|---|
| FR | 1 564 803 | 4/1969 |

(Continued)

*Primary Examiner*—Joseph Edell
(74) *Attorney, Agent, or Firm*—Edell, Shapiro & Finnan LLC

(57) ABSTRACT

An infant support includes a base member, a tray, a first leg, a second leg and an adjustment member. The base member includes a seat portion and an upright portion. The tray is configured to be removably coupled to the upright portion. The first leg is configured to support the base member and is slidably coupled to the base member such that the first leg can be selectively placed in a first position in which the first leg is retracted and a second position in which the first leg is fully extended. The second leg is configured to support the base member and is slidably coupled to the base member. The adjustment member is slidably coupled to the base member between the first leg and the second leg and is configured to retain the first leg in at least one of the first position or the second position.

31 Claims, 20 Drawing Sheets

U.S. PATENT DOCUMENTS

| | | | | | |
|---|---|---|---|---|---|
| 2,282,881 | A | | 5/1942 | Ostrow | |
| 2,301,673 | A | | 11/1942 | Allen | |
| 2,402,861 | A | | 6/1946 | Winnick | |
| 2,505,490 | A | | 4/1950 | Greenbaum | |
| 2,515,527 | A | * | 7/1950 | Robinson | 297/311 |
| 2,544,896 | A | | 3/1951 | Nidetch et al. | |
| 2,560,708 | A | | 7/1951 | Titus | |
| 2,667,207 | A | | 1/1954 | Magyar | |
| 2,672,182 | A | | 3/1954 | Gwin et al. | |
| 2,684,110 | A | | 7/1954 | Stone | |
| 2,691,411 | A | | 10/1954 | Thatcher | |
| 2,705,994 | A | | 4/1955 | Stattler | |
| 2,709,904 | A | | 6/1955 | Boughton | |
| 2,724,429 | A | | 11/1955 | Warner | |
| 2,726,838 | A | | 12/1955 | Ripley, Jr. | |
| 2,762,161 | A | | 9/1956 | Danielson | |
| 2,790,484 | A | * | 4/1957 | Pollack | 280/47.4 |
| 2,799,324 | A | | 7/1957 | Anderson | |
| 2,826,469 | A | | 3/1958 | Grant | |
| 2,902,084 | A | | 9/1959 | Stevens | |
| 2,934,135 | A | | 4/1960 | Lesh | |
| 2,935,122 | A | | 5/1960 | Miller | |
| 2,971,567 | A | | 2/1961 | Kimmel | |
| 3,014,307 | A | | 12/1961 | Dupuis | |
| 3,143,374 | A | | 8/1964 | Carboni | |
| 3,204,367 | A | | 9/1965 | Stubbmann | |
| 3,330,597 | A | | 7/1967 | Lay et al. | |
| 3,383,134 | A | | 5/1968 | Webb et al. | |
| 3,415,570 | A | | 12/1968 | Mosley et al. | |
| 3,425,744 | A | | 2/1969 | Spector et al. | |
| 3,475,052 | A | | 10/1969 | Kaposi | |
| 3,490,808 | A | | 1/1970 | Siegel | |
| 3,512,297 | A | | 5/1970 | Malherbe et al. | |
| 3,516,709 | A | | 6/1970 | Nader | |
| 3,635,522 | A | | 1/1972 | Kerwit | |
| 3,649,074 | A | | 3/1972 | McDonald et al. | |
| 3,698,594 | A | | 10/1972 | Boehlert | |
| 3,729,037 | A | | 4/1973 | Dare et al. | |
| D229,999 | S | | 1/1974 | Blazey et al. | |
| 3,877,603 | A | | 4/1975 | Holz | |
| 3,944,109 | A | | 3/1976 | Holz | |
| 4,082,349 | A | | 4/1978 | Ballenger | |
| 4,094,547 | A | | 6/1978 | Zampino et al. | |
| 4,105,247 | A | | 8/1978 | Saint | |
| 4,143,915 | A | | 3/1979 | Kamlay | |
| 4,266,306 | A | * | 5/1981 | Lee | 4/572.1 |
| 4,298,228 | A | | 11/1981 | Zampino et al. | |
| 4,427,391 | A | | 1/1984 | Berman | |
| 4,512,607 | A | | 4/1985 | Rapp | |
| 4,582,359 | A | | 4/1986 | Wise et al. | |
| D283,956 | S | | 5/1986 | Lemmeyer | |
| 4,603,903 | A | * | 8/1986 | Moscovitch | 297/256.11 |
| 4,606,576 | A | | 8/1986 | Jones | |
| 4,634,185 | A | | 1/1987 | Kassai | |
| 4,640,033 | A | | 2/1987 | Bulger | |
| 4,723,813 | A | | 2/1988 | Kassai | |
| 4,770,410 | A | * | 9/1988 | Brown | 482/68 |
| 4,807,928 | A | | 2/1989 | Cone | |
| 4,842,331 | A | | 6/1989 | Waples | |
| 4,844,537 | A | | 7/1989 | Reed | |
| 4,938,603 | A | | 7/1990 | Turner et al. | |
| 4,942,827 | A | | 7/1990 | Norgaard | |
| 4,968,092 | A | | 11/1990 | Giambrone | |
| 5,071,149 | A | | 12/1991 | Perego | |
| 5,081,936 | A | | 1/1992 | Drieling | |
| 5,094,505 | A | | 3/1992 | Nichols | |
| D326,123 | S | | 5/1992 | Connon | |
| 5,118,161 | A | | 6/1992 | Slowe et al. | |
| 5,131,719 | A | | 7/1992 | Kassai | |
| D328,624 | S | | 8/1992 | Hu | |
| 5,165,755 | A | | 11/1992 | Rho | |
| 5,170,720 | A | | 12/1992 | Scheurer | |
| D333,060 | S | | 2/1993 | Perego | |
| 5,183,311 | A | | 2/1993 | Meeker et al. | |
| 5,238,292 | A | * | 8/1993 | Golenz et al. | 297/153 |
| D339,772 | S | | 9/1993 | Hu | |
| 5,254,007 | A | | 10/1993 | Eagan | |
| 5,294,172 | A | | 3/1994 | Dubus | |
| 5,332,241 | A | | 7/1994 | Rho | |
| 5,346,279 | A | | 9/1994 | Pecorella | |
| 5,348,368 | A | | 9/1994 | Garcia et al. | |
| 5,348,374 | A | | 9/1994 | Kuo | |
| 5,368,183 | A | | 11/1994 | Singer | |
| D356,531 | S | | 3/1995 | Valenti | |
| D357,129 | S | | 4/1995 | Tiramani | |
| 5,407,246 | A | * | 4/1995 | Meeker et al. | 297/137 |
| D358,730 | S | | 5/1995 | Meeker et al. | |
| 5,438,938 | A | * | 8/1995 | Meeker et al. | 108/91 |
| 5,468,043 | A | | 11/1995 | Chien | |
| 5,468,051 | A | | 11/1995 | Huang | |
| D364,746 | S | | 12/1995 | Lerner et al. | |
| D364,896 | S | | 12/1995 | Wu | |
| 5,474,355 | A | | 12/1995 | Lerner et al. | |
| 5,489,138 | A | | 2/1996 | Mariol et al. | |
| 5,494,333 | A | * | 2/1996 | Wilson | 297/344.18 |
| 5,507,550 | A | | 4/1996 | Maloney | |
| 5,509,719 | A | | 4/1996 | Cone, II | |
| 5,527,090 | A | | 6/1996 | Cone, II | |
| 5,538,432 | A | | 7/1996 | Dondero et al. | |
| 5,558,391 | A | | 9/1996 | Chavous | |
| D374,125 | S | | 10/1996 | Bernstein et al. | |
| 5,560,653 | A | | 10/1996 | Beppu | |
| 5,586,800 | A | | 12/1996 | Triplett | |
| 5,590,939 | A | | 1/1997 | Piontek | |
| 5,599,063 | A | * | 2/1997 | Lister et al. | 297/325 |
| 5,609,389 | A | | 3/1997 | Longoria et al. | |
| 5,615,925 | A | | 4/1997 | Kain | |
| 5,642,917 | A | | 7/1997 | Geiger | |
| 5,660,432 | A | | 8/1997 | Davis | |
| D383,338 | S | | 9/1997 | Gibbs | |
| D383,911 | S | | 9/1997 | Conforti et al. | |
| 5,662,378 | A | | 9/1997 | Carruth | |
| 5,688,211 | A | * | 11/1997 | Myers | 482/66 |
| 5,690,383 | A | | 11/1997 | Meeker | |
| 5,709,582 | A | | 1/1998 | O'Donnell | |
| 5,720,226 | A | | 2/1998 | Padovano | |
| D391,407 | S | | 3/1998 | Rossman et al. | |
| 5,732,849 | A | | 3/1998 | Brooks | |
| 5,810,432 | A | | 9/1998 | Haut et al. | |
| 5,820,207 | A | | 10/1998 | Wang | |
| 5,823,615 | A | | 10/1998 | Haut | |
| 5,829,826 | A | | 11/1998 | Ziccardi | |
| 5,836,650 | A | * | 11/1998 | Warner et al. | 297/256.11 |
| D402,931 | S | | 12/1998 | Huang | |
| D409,026 | S | | 5/1999 | Rosko et al. | |
| 5,951,102 | A | | 9/1999 | Poulson et al. | |
| 5,975,628 | A | | 11/1999 | Russell | |
| 5,992,932 | A | | 11/1999 | Kain et al. | |
| 6,000,750 | A | | 12/1999 | Rossman et al. | |
| 6,015,190 | A | | 1/2000 | Wend | |
| 6,022,277 | A | | 2/2000 | Jankowski | |
| 6,033,019 | A | | 3/2000 | Hession-Kunz et al. | |
| 6,050,643 | A | | 4/2000 | Kain et al. | |
| 6,059,358 | A | | 5/2000 | Demick et al. | |
| D427,822 | S | | 7/2000 | Greger | |
| 6,082,814 | A | | 7/2000 | Celestina-Krevh et al. | |
| 6,085,666 | A | | 7/2000 | Anderson et al. | |
| 6,089,653 | A | | 7/2000 | Hotaling et al. | |
| 6,095,607 | A | * | 8/2000 | Wenzel | 297/344.18 |
| 6,119,996 | A | | 9/2000 | Connery | |
| 6,126,236 | A | | 10/2000 | Wu | |
| 6,179,377 | B1 | | 1/2001 | Harper | |
| 6,216,605 | B1 | | 4/2001 | Chapman | |
| D447,445 | S | | 9/2001 | Lu | |

| | | | | |
|---|---|---|---|---|
| 6,298,793 | B1 | 10/2001 | Turner et al. | |
| 6,305,299 | B1 * | 10/2001 | Ragland | 108/44 |
| 6,349,654 | B1 | 2/2002 | Peters | |
| 6,491,343 | B2 | 12/2002 | Yamazaki | |
| 6,578,496 | B2 | 6/2003 | Guard et al. | |
| 6,773,064 | B2 | 8/2004 | Treen et al. | |
| 6,832,813 | B2 * | 12/2004 | Tomas et al. | 297/250.1 |
| 6,851,375 | B2 | 2/2005 | Guard et al. | |
| 6,920,830 | B1 | 7/2005 | Asbach et al. | |
| 7,032,970 | B1 * | 4/2006 | Kharat | 297/256.11 |
| 7,104,603 | B2 * | 9/2006 | Keegan et al. | 297/256.13 |
| 7,207,628 | B2 * | 4/2007 | Eros | 297/297 |
| 7,673,940 | B2 * | 3/2010 | Fritz et al. | 297/256.11 |
| 2001/0035112 | A1 | 11/2001 | Guard et al. | |
| 2003/0067198 | A1 * | 4/2003 | Treen et al. | 297/250.1 |
| 2003/0151285 | A1 * | 8/2003 | Keegan et al. | 297/256.13 |

FOREIGN PATENT DOCUMENTS

| | | | |
|---|---|---|---|
| FR | 2 589 706 | A1 | 5/1987 |
| GB | 1 268 063 | | 3/1972 |
| GB | 2 121 270 | A | 12/1983 |
| WO | WO 03/016089 | A2 | 2/2003 |
| WO | WO 03/024273 | A1 | 3/2003 |

* cited by examiner

INFANT SUPPORT WITH INDEPENDENTLY REPOSITIONABLE LEGS

CROSS REFERENCE TO RELATED APPLICATIONS

This application is a Divisional of U.S. application Ser. No. 10/835,267, filed Apr. 30, 2004, now U.S. Pat. No. 7,328,941 entitled "Infant Support With Selectively Covered Tray," the entirety of which is incorporated herein by reference.

BACKGROUND

The invention relates generally to infant supports, and more particularly to infant supports that include tray members.

Infants and children are often not tall enough to reach conventional tables while seated in conventional chairs. Accordingly, high chairs, booster seats, and other types of infant supports have been developed, which provide a suitable feeding environment for infants and small children. Some high chairs and booster seats include tray members that may be used to support food or other items for the infant or child.

Conventional high chairs and booster seats that include tray members, however, do not include lids or other types of covering devices configured to cover the feeding surface of the tray members. Thus, food and/or other items that are placed on the tray members may fall from the tray members during the transportation of the tray members. For example, after an infant or a child has finished eating a meal, a parent or a caregiver may attempt to transport the tray member of the high chair or booster seat with the remaining food on the tray member. As the parent or caregiver transports the tray member, the remaining food may slide off of or otherwise fall from the tray member. Additionally, any food that was not consumed by the child during a meal must be stored in a separate container, rather than remaining on the tray because the tray cannot be covered.

Thus, a need exists for a high chair, a booster seat, or other type of infant or child support that includes a tray member that has a lid or other device configured to cover at least one side of the tray member. Further, a need exists for such an infant or child support where the tray member can be attached to the support in a storage position and transported as an assembly with the lid or other device covering the tray member.

SUMMARY OF THE INVENTION

An infant support includes a seat and an upright member that extends from the seat. A tray has a first member, a second member, and a third member. The first member of the tray is configured to be removably coupled to the upright member. Additionally, the second member of the tray is configured to be removably coupled between the first member and the third member.

DETAILED DESCRIPTION

Figure 1:
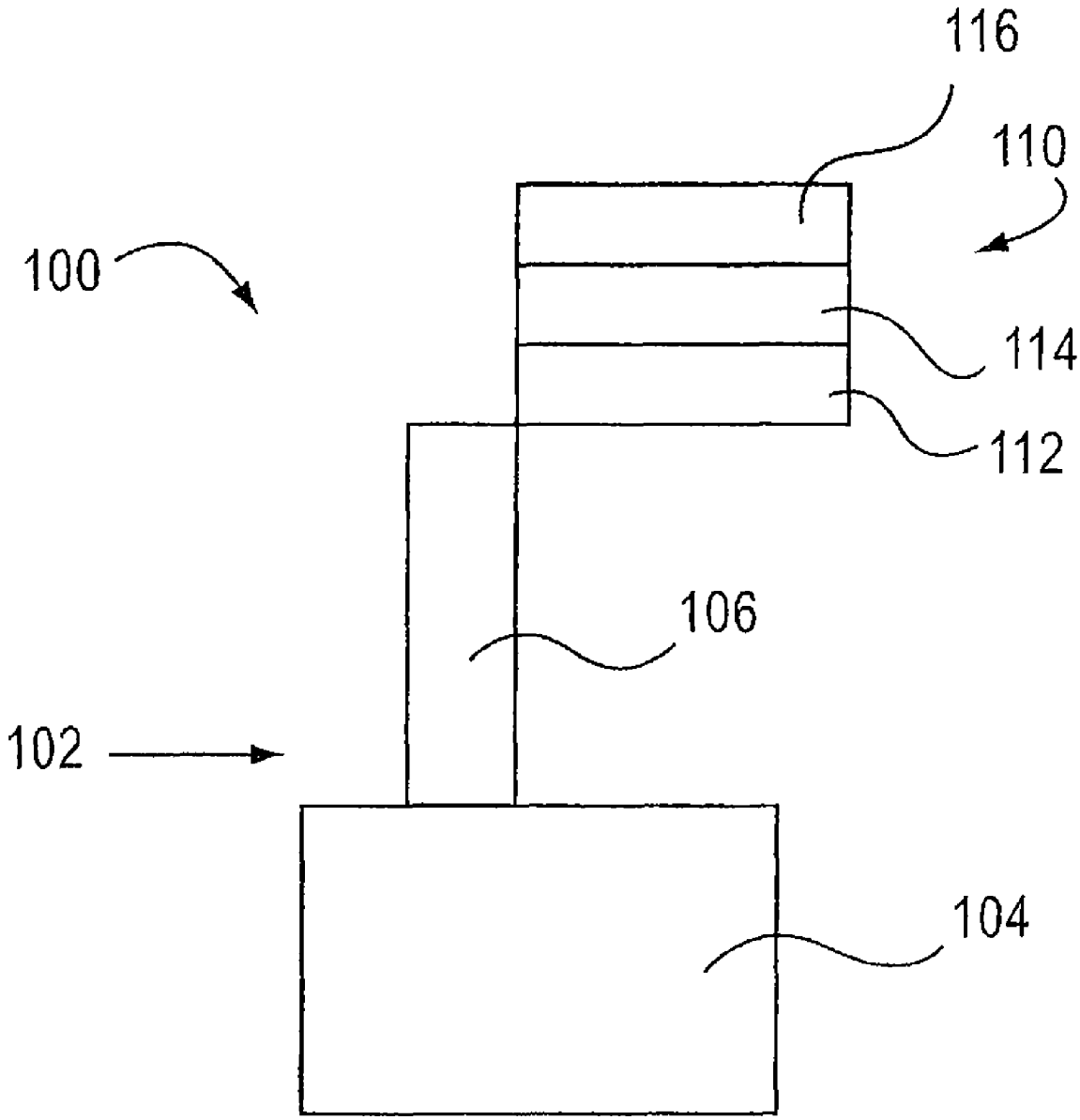
FIG. 1 is a schematic illustration of a generic embodiment of an infant or child support having a tray member in accordance with the invention.

FIG. 1 is a schematic illustration of a generic embodiment of an infant or child support 100 that includes a base member 102 and a tray member 110. The base member 102 includes a seat member 104 and an upright member 106 that extends from the seat member 104. In one embodiment, the seat member 104 is configured to support an infant or a child in a seated position. In one embodiment, the upright member 106 is a backrest and is configured to support a back of an infant or child that is seated on the seat member 104, or otherwise prevent the infant from sliding from the seat member 104. In another embodiment, the upright member 106 is an arm portion and is configured to support an arm of an infant of child that is seated on the seat member 104, or otherwise prevent the infant from sliding from the seat member 104. Trays for use with infant supports are disclosed in U.S. application Ser. No. 09/954,448, filed on Sep. 18, 2001, entitled "Removable Tray Insert and Tray Set," which is incorporated herein by reference in its entirety.

The tray member 110 includes a first member 112, a second member 114, and a third member 116. The first member 112 of the tray member 110 is coupled to the upright member 106 of the base member 102. In one embodiment, the first member 112 of the tray member 110 is removably coupled to the upright member 106.

The second member 114 of the tray member 110 is configured to be positioned between the first member 112 of the tray member 110 and the third member 116 of the tray member 110. In one embodiment, the second member 114 of the tray member 110 is configured to be positioned between the first member 112 of the tray member 110 and the third member 116 of the tray member 110 such that there is an open space or cavity between the second member 114 of the tray member 110 and the third member 116 of the tray member 110. In one embodiment the second member 114 is configured to be removably coupled to the first member 112 of the tray member 110, and the third member 116 of the tray member 110 is configured to be removably coupled to the second member 114 of the tray member 110.

The terms "infant" and "child" are used herein interchangeably. Specifically, the terms "infant" and "child" should be interpreted to mean the same thing. For example, an infant support is the same as a child support and vice versa.

Figure 2:
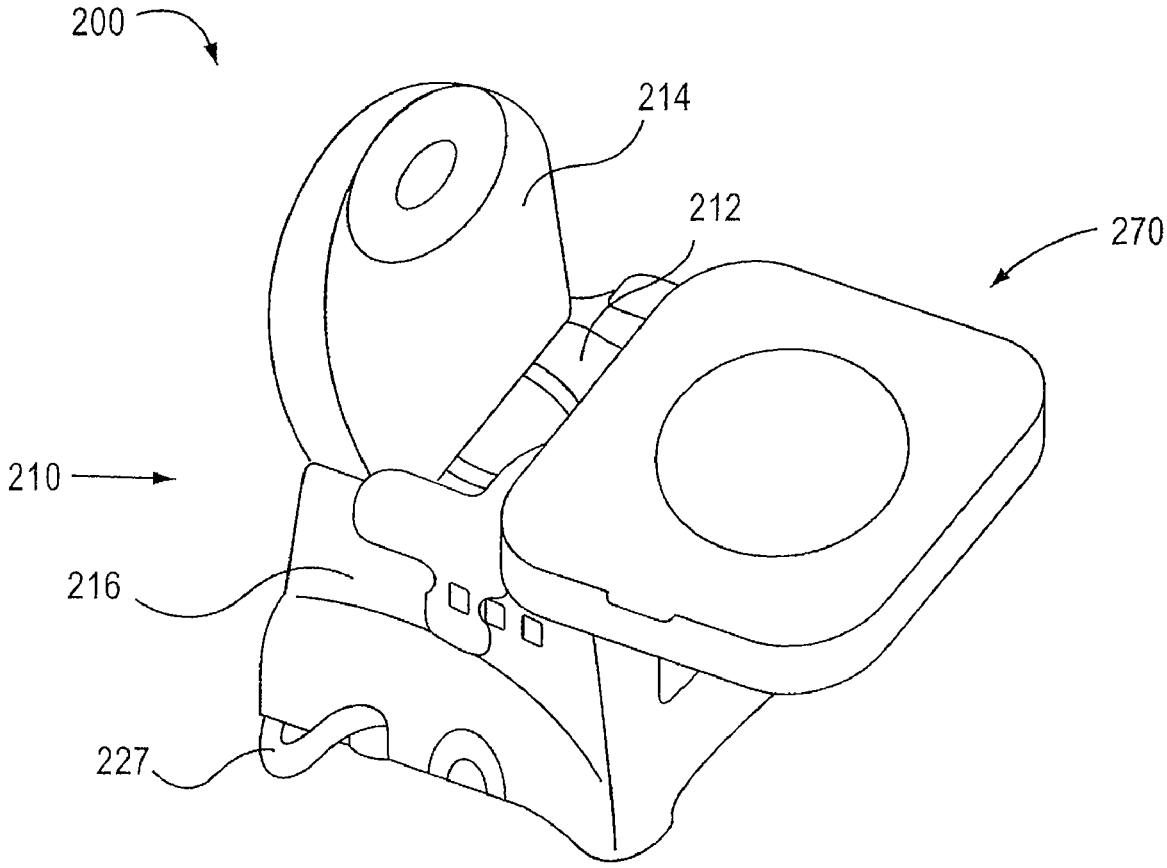
FIG. 2 is a perspective view of an embodiment of a child support in accordance with the invention.
Figure 3:
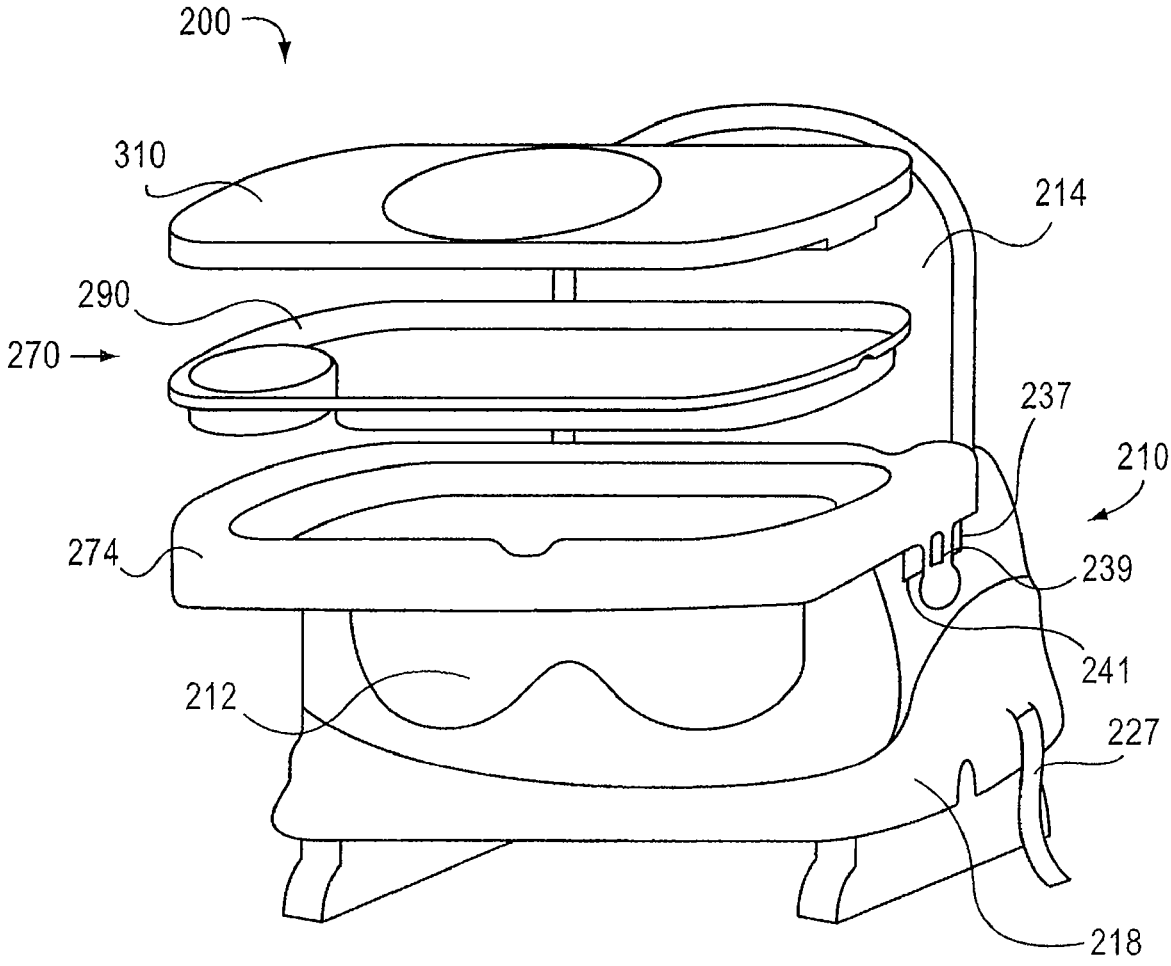
FIG. 3 is a partially exploded view of the child support of FIG. 2.

One implementation of the infant support discussed above is now described with reference to FIGS. 2-25. FIGS. 2 and 3 illustrate an embodiment of an infant or child support according to an embodiment of the invention. The infant support 200 includes a base member 210 and a tray member 270. The base member 210 includes a seat or seat portion 212, a back member or back portion 214, and a pair of arm portions 216 and 218. The back portion 214 of the base member 210 and the arm portions 216 and 218 of the base member 210 are coupled to, and extend from, the seat portion 212 of the base member 210. The back portion 214 of the base member 210 and the arm portions 216 and 218 extend upwardly from the seat portion 212 of the base member 210. In other words, the back portion 214 and the arm portions 216 and 218 are upright members or portions.

FIGS. 4 through 9 illustrate the base member 210 according to an embodiment of the invention. The arm portions 216 and 218 are integrally or unitarily formed with the seat portion 212 of the base member 210. In an alternative embodiment, the arm portions 216 and 218 are not integrally or unitarily formed with the seat portion 212. Rather, the arm portions 216 and 218 are pivotally coupled, fixedly coupled, or otherwise coupled to the seat portion 212.

Figure 4:
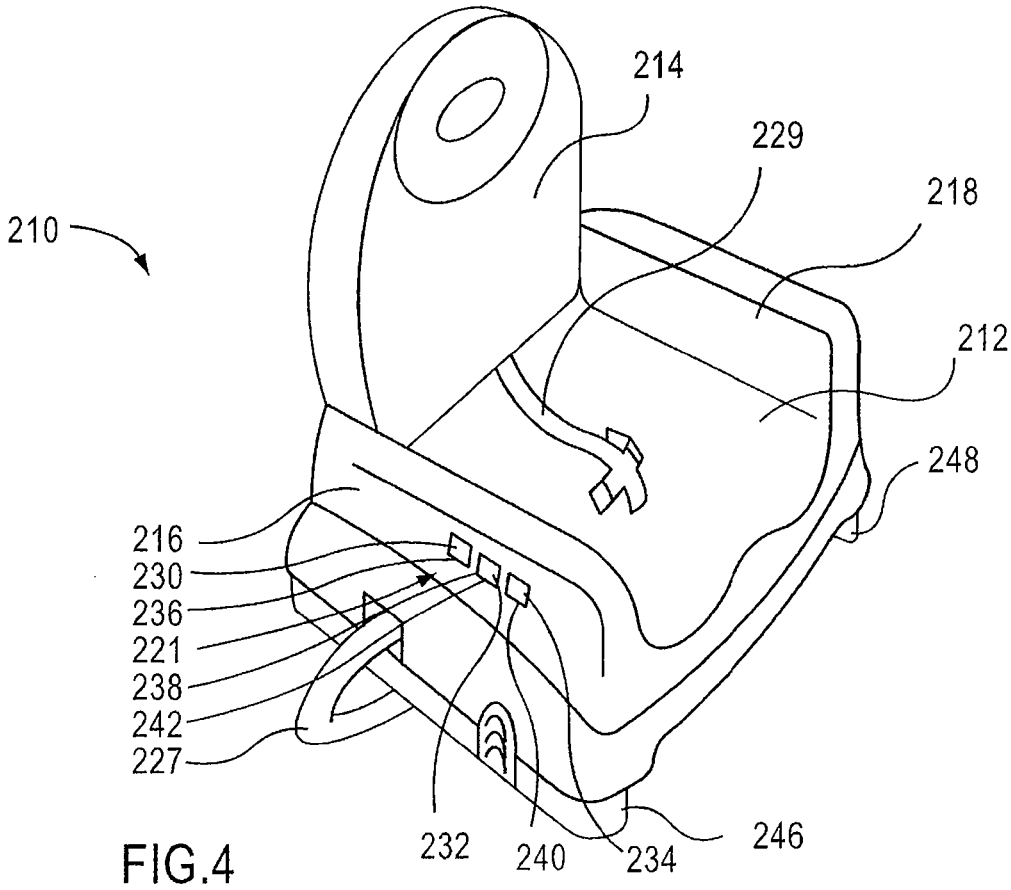
FIGS. 4 and 5 are perspective views of a base member of the child support of FIG. 2.
Figure 5:
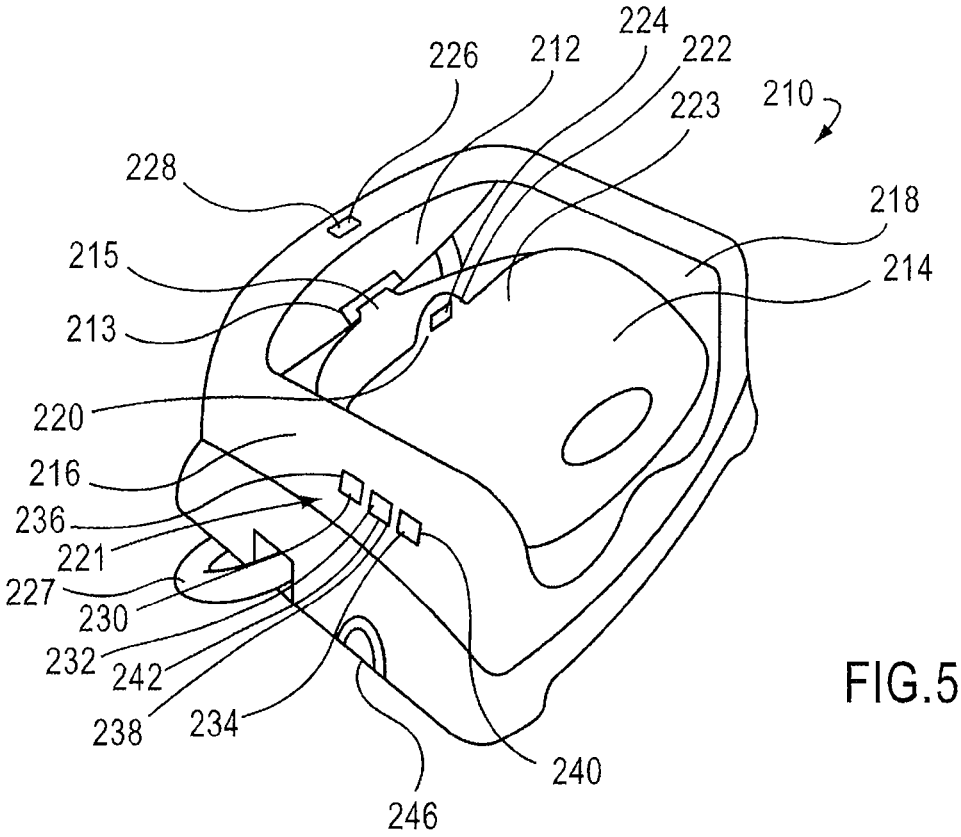
Figure 6:
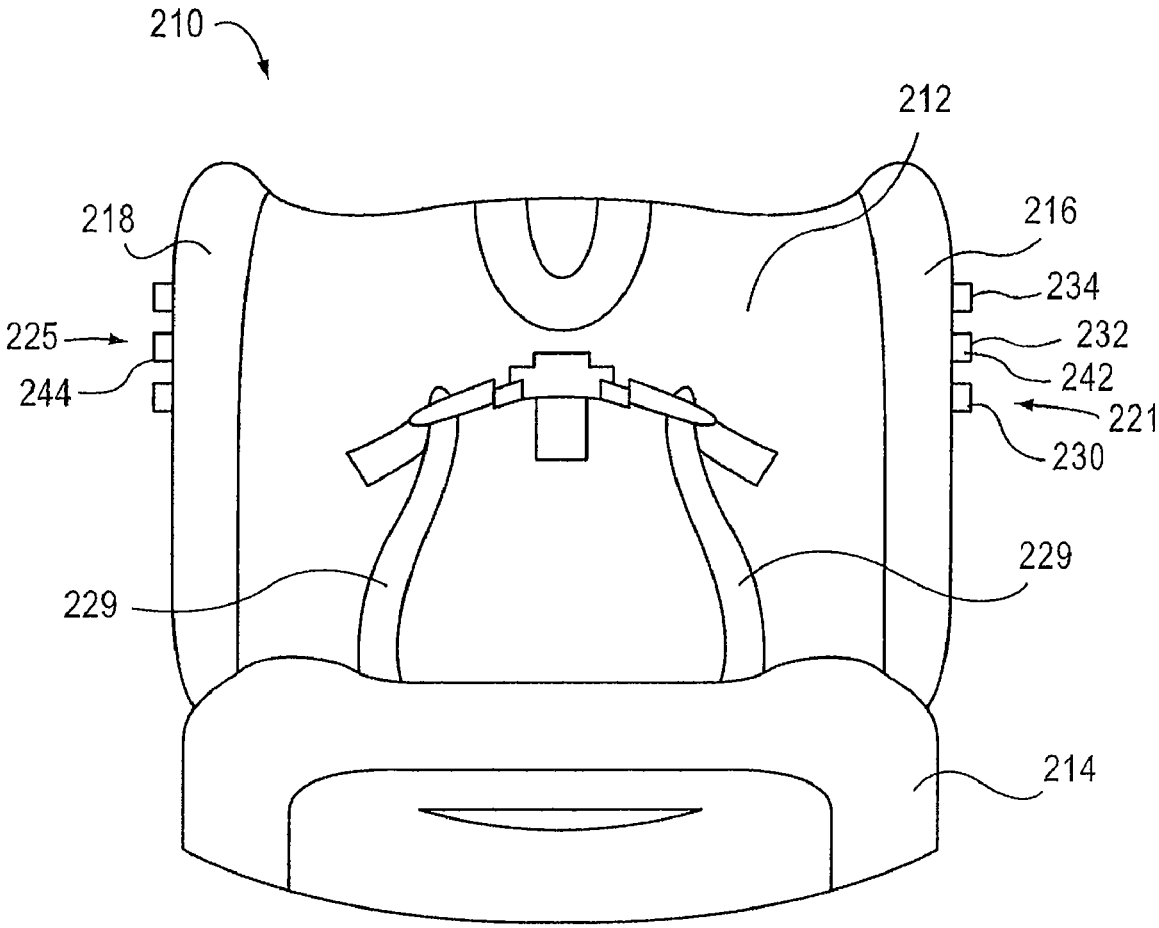
FIG. 6 is a top view of the base member of FIG. 4.
Figure 7:
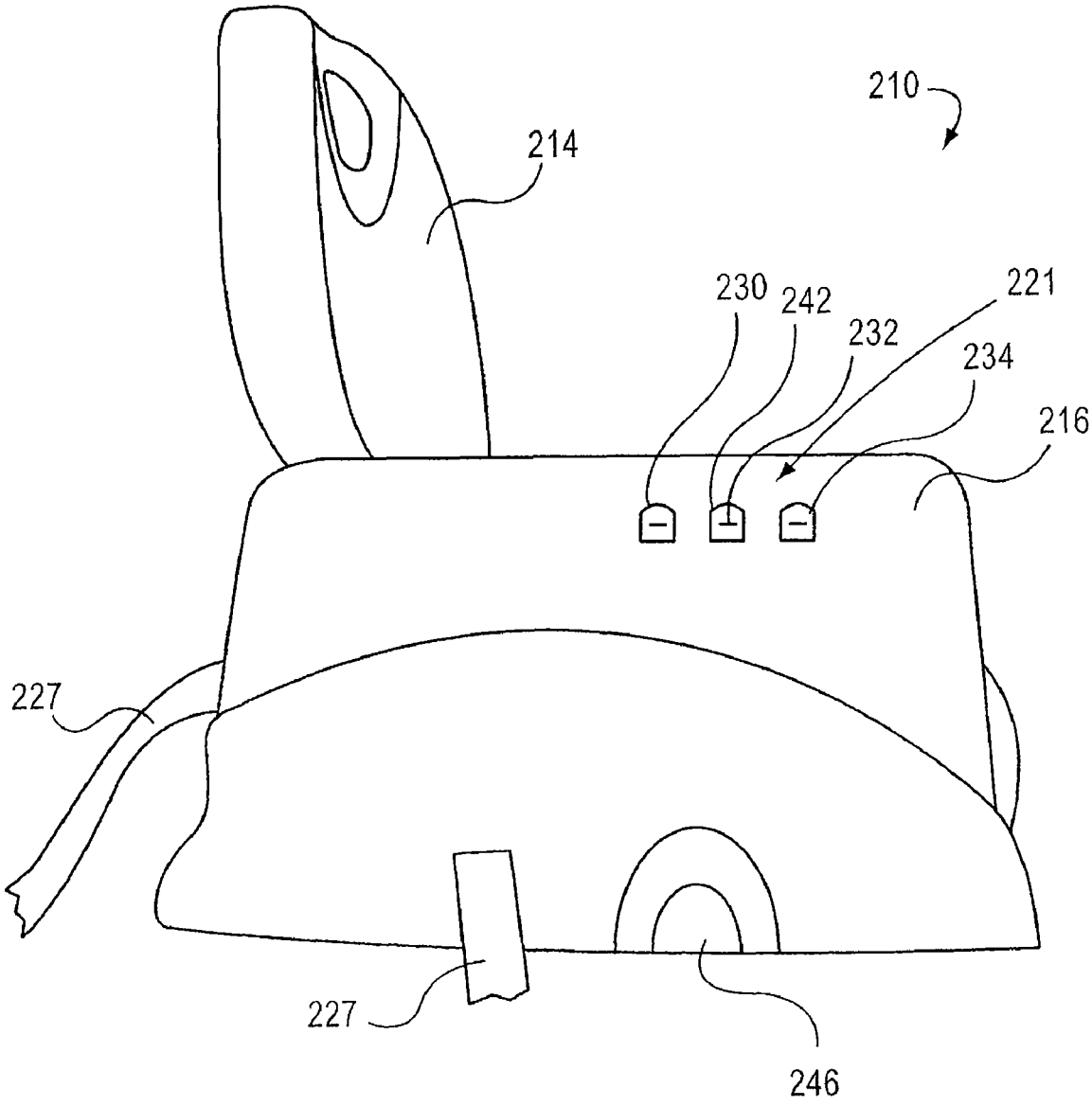
FIG. 7 is a side view of the base member of FIG. 4.
Figure 8:
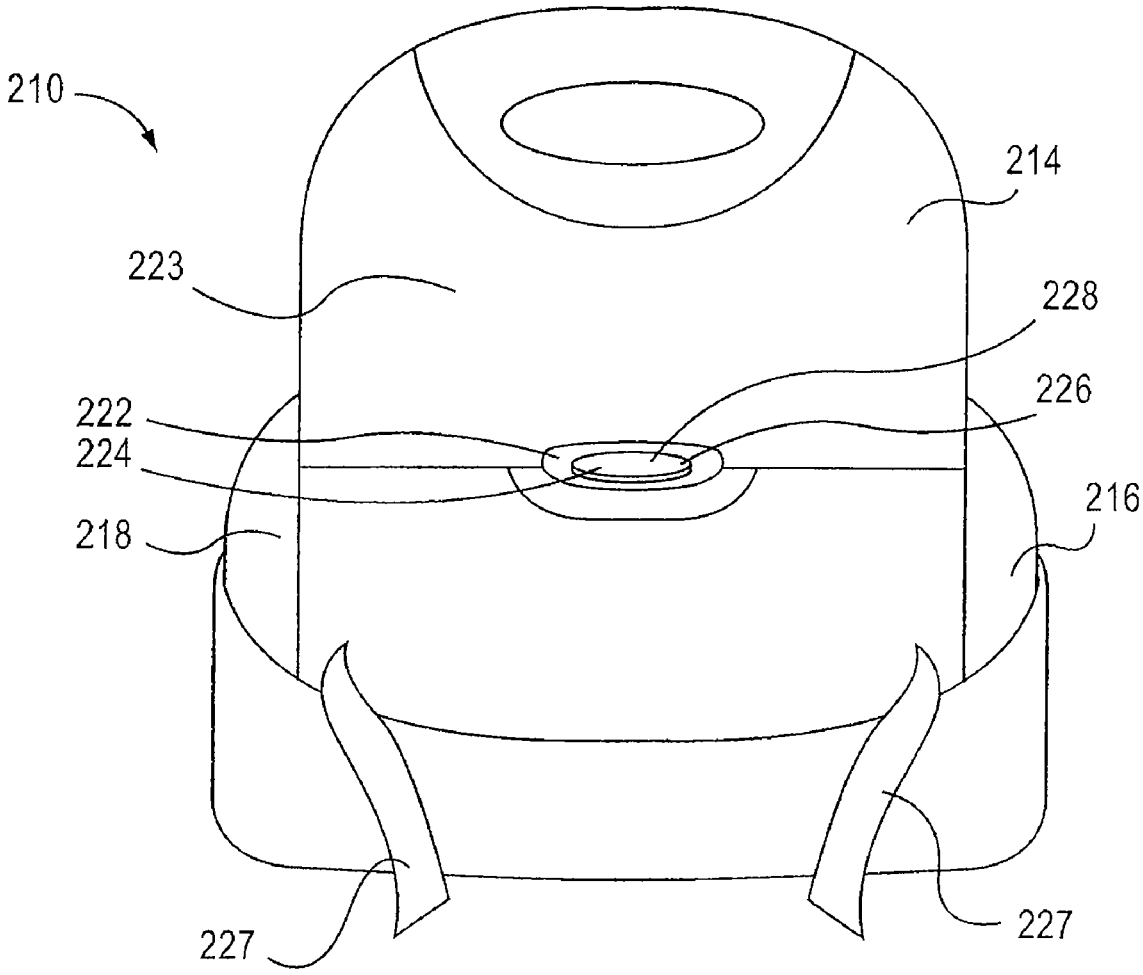
FIG. 8 is a rear view of the base member of FIG. 4.

As best illustrated in FIGS. 4 and 5, the back portion 214 is pivotally coupled to the seat portion 212 of the base member 210 and may be placed in an upright or use position (FIG. 4) or in a parallel, collapsed, or storage configuration (FIG. 5). In an alternative embodiment, the seat portion is not pivotally coupled to the seat member. Rather, the seat portion is integrally or unitarily formed with the seat member. In a further alternative embodiment, the back portion 214 is removable from the base member 210.

Figure 25:
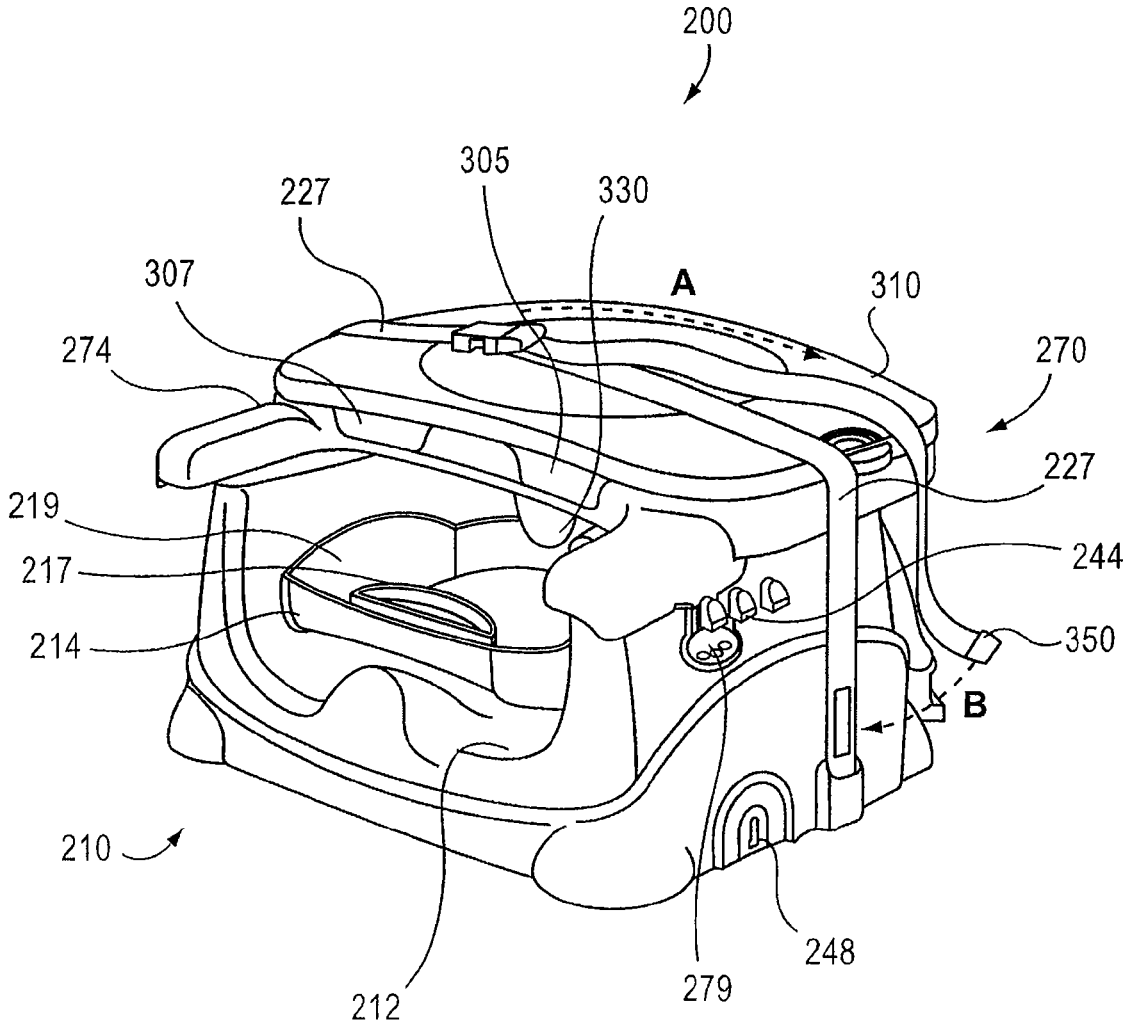
FIG. 25 is a perspective view of the child support of FIG. 2 in a collapsed configuration.
Figure 26:
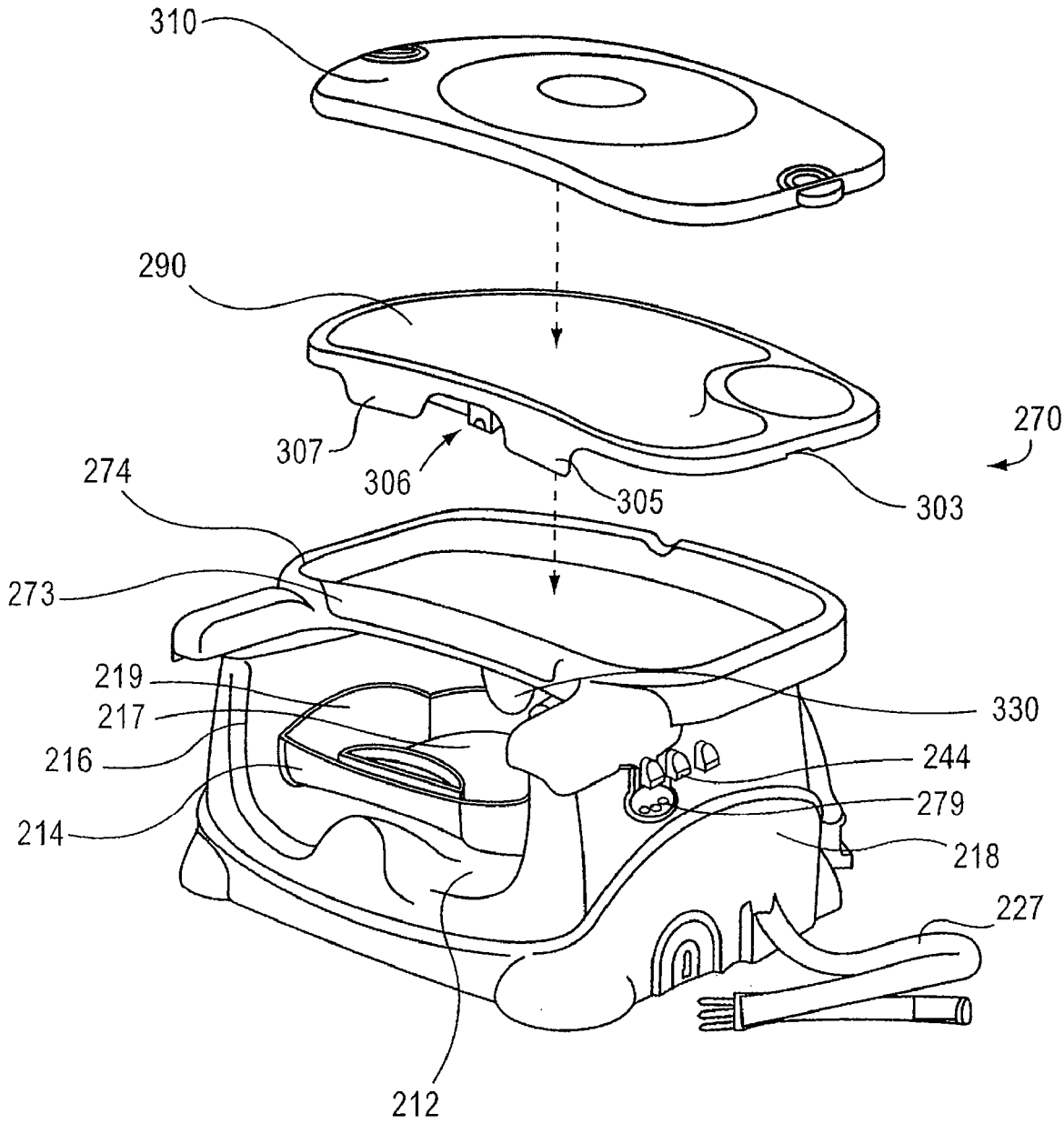
FIG. 26 is a partially exploded perspective view of the child support in a collapsed configuration.

The back portion 214 includes an extension member 215 that extends into and is retained within an opening 213 of the seat portion 212 to pivotally couple the back portion 214 to the seat portion 212. The back portion 214 includes a locking portion 220 that cooperates with a locking portion 226 of the seat member 212 to secure or lock the back portion 214 in its upright or use position (See FIG. 5). The back portion 214 includes a perimeter wall 219 and the extension member 215. As shown in FIGS. 25 and 26, the perimeter wall 219 defines a recess 217.

In the illustrated embodiment, the locking portion 220 of the back portion 214 includes a flange 222 that extends from a rear portion 223 of the back portion 214 and defines an opening 224. The locking portion 226 of the seat portion 212 includes a projection 228. The opening 224 of the back portion 214 is configured to receive the projection 228 of the seat portion 212 when the back portion 214 of the base member 210 is in its upright or use configuration to retain the back portion 214 in its upright or use configuration. The flange 222 may be bent or flexed such that the projection 228 is removed from the opening 224 to allow the back portion 214 to be pivoted with respect to the seat portion 212 to convert the back portion 214 from its upright or use configuration to its parallel or collapsed configuration.

In an alternative embodiment, the back portion 214 and/or the seat portion 212 include another mechanism for securing the back portion 214 in its upright or use configuration. For example, in one embodiment, a pair of straps with a snap or buckle system is used to secure the back portion 214 in its upright or use configuration. In another embodiment, the back portion 214 does not lock into its upright or use configuration. In other words, neither the back portion 214 nor the seat portion 212 include a locking portion in such an embodiment.

In the illustrated embodiment, when the back portion 214 is in its upright or use configuration, the base member 210 is configured to support a user, such as a child, in a seated position. For example, a child may sit on the seat portion 212 of the base member 210. Once the child has sat on the seat portion 212, the child may rest or otherwise lean against the back portion 214 of the base member 210 and may rest an arm on one or both of the arm portions 216 and 218 of the base member 210.

In an alternative embodiment, the base member 210 includes a back portion and does not include arm portions. In another alternative embodiment, the base member 210 includes an arm portion and does not include a back portion.

Arm portion 216 defines openings 236, 238, and 240. Similarly, arm portion 218 defines openings 237, 239, and 241. The arm portions 216 and 218 also each include a coupling portion 221 and 225, respectively. As will be discussed in detail below, the coupling portions 221 and 225 are configured to cooperate with coupling portions 279 and 280 of the first member 274 of the tray member 270 of the child support 200 to removably couple the tray member 270 of the child support 200 to the base member 210 of the child support 200.

Figure 14:
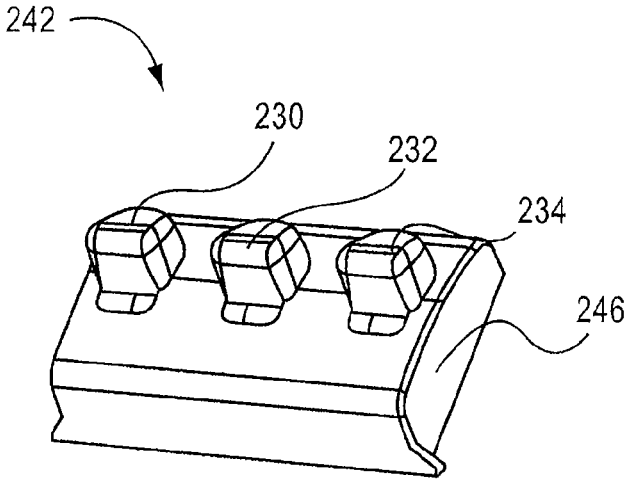
FIG. 14 is a perspective view of a coupling member of the base member of FIG. 4.
Figure 15:
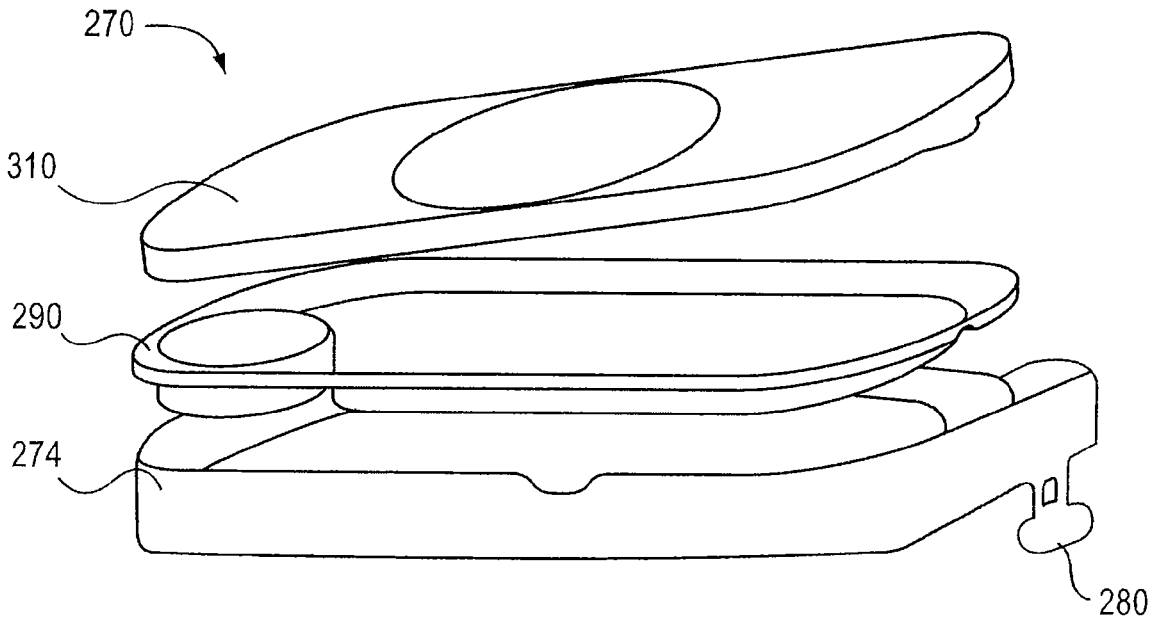
FIG. 15 is an exploded view of the tray member of the child support of FIG. 2.
Figure 16:
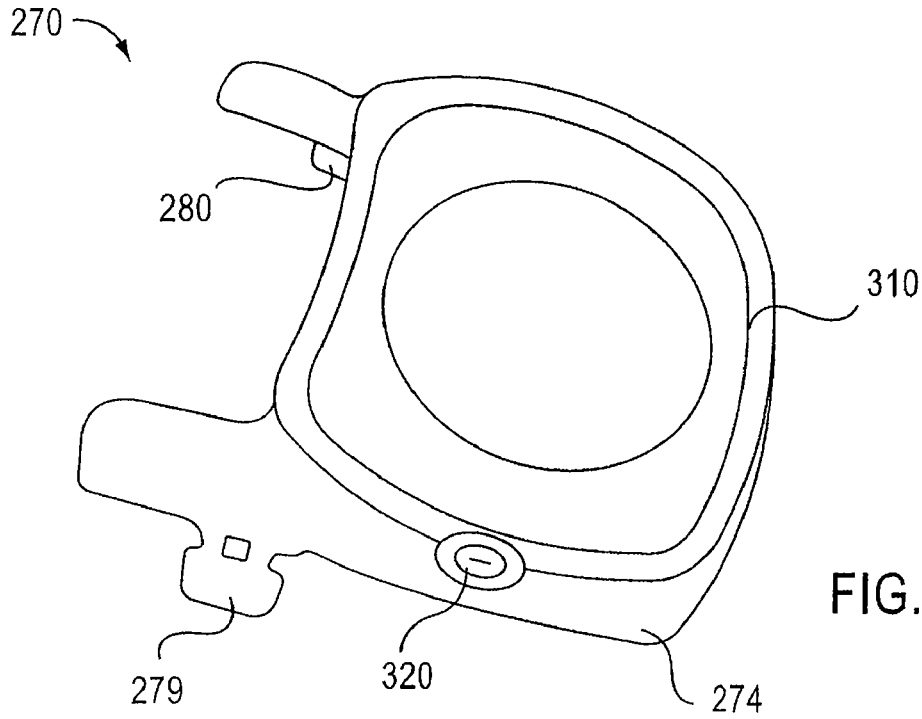
FIG. 16 is a perspective view of the tray member of FIG. 15.
Figure 17:
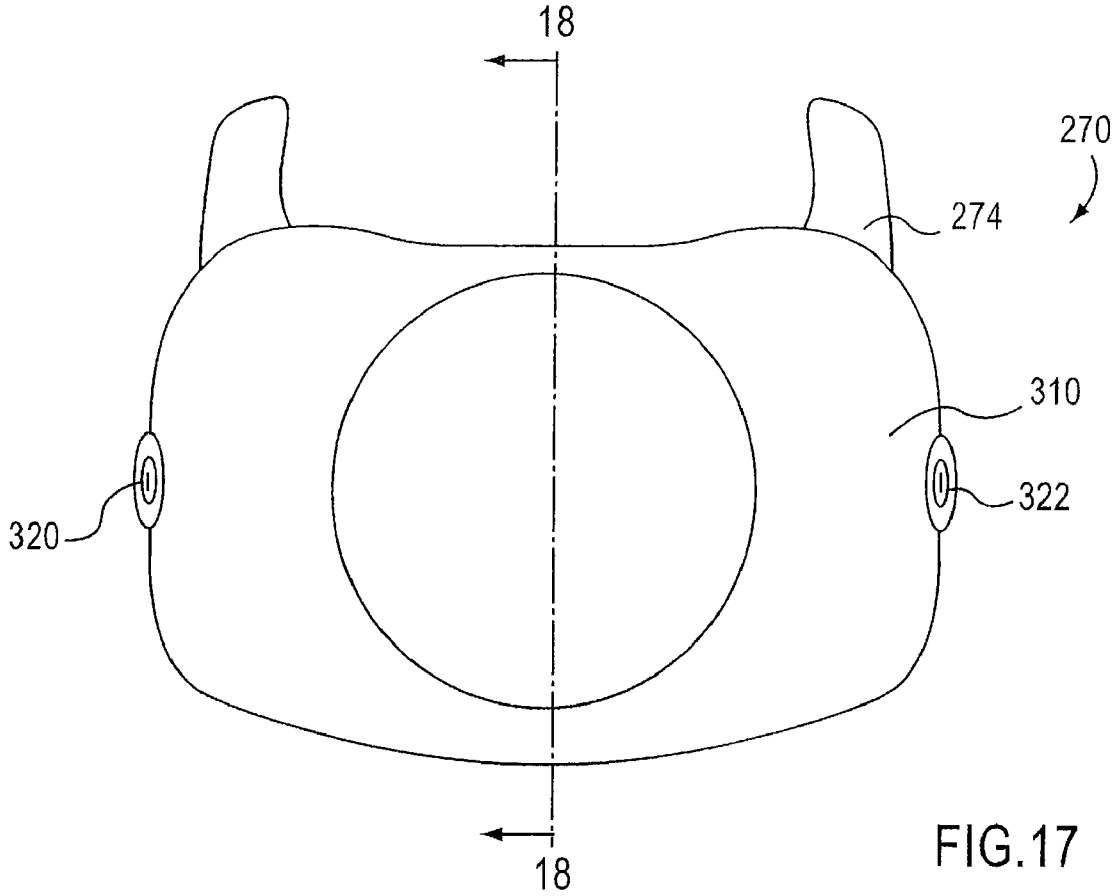
FIG. 17 is a top view of the tray member of FIG. 15.

In the illustrated embodiment, each of the arm portions 216 and 218 define a cavity (not illustrated). Coupling members 242 and 244 are coupled within and extend or protrude from the cavities that are defined by each of the arm portions 216 and 218, respectively. Coupling members 242 and 244 are structurally and functionally similar. Accordingly, only coupling member 242 will be discussed and illustrated in detail. As illustrated in FIG. 14, coupling member 242 includes a base 246 and projections 230, 232, and 234. The base 246 of the coupling member 242 is configured to be coupled within the cavity defined by arm portion 216 such that the projections 230, 232, and 234 protrude through the openings 236, 238, and 240, respectively, of the arm portion 216.

Although in the illustrated embodiment the coupling members each include three projections, it is not necessary that the coupling member have three projections. In one embodiment, the coupling members each have less than three projections. In another embodiment, the coupling members each have more than three projections.

In one embodiment, the coupling member 242 is coupled to arm portion 216 via an adhesive, such as glue. In another embodiment, the coupling member is coupled to the arm portion via another known coupling mechanism, such as radio frequency (RF) welding or a mechanical fastener such as a screw.

In an alternative embodiment, the coupling members are not coupled to the arm portions. Rather, in one embodiment the arm portions each include projections that are integrally or unitarily formed with the arm portion. In a further embodiment, each of the projections is individually formed and is coupled to the arm portion.

The base member 210 includes leg portions 246 and 248 that are slidably coupled to the base member 210. The leg portions 246 and 248 are configured to be placed in a an extended configuration (FIG. 4) to raise the seat portion 212 of the base member 210 with respect to a support surface. The leg portions 246 and 248 are also configured to be placed in a retracted configuration (FIG. 5) to lower the seat portion 212 of the base member 210 with respect to a support surface. In the illustrated embodiment, the leg portions 246 and 248 may also be placed in a middle configuration (the leg portions 246 and 248 extend from the base member 210 further than they do in the retracted configuration but not as far as they do in the extended configuration).

Leg portions 246 and 248 are structurally and functionally similar. Accordingly, only leg portion 246 will be illustrated and described in detail. As illustrated in FIGS. 9 through 12, leg portion 246 includes a support portion 250 and an adjustment portion 252. The support portion 250 is configured to contact a support surface to allow the base member 210 to be placed on and supported by a support surface. The adjustment portion 252 of the leg portion 246 includes multiple receiving portions 254. As will be described in detail below, the receiving portions 254 are configured to receive extension portions 258 of an adjustment member 256 of the base member 210.

In an alternative embodiment, the leg portions are not slidably coupled to the base member. For example, the leg portions may be fixedly coupled to the base member or may be integrally or unitarily formed with the base member. In another alternative embodiment, the base member does not include leg portions. Rather, the base member is configured to be placed directly upon a support surface.

The base member 210 includes adjustment members 256 and 257. The adjustment members 256 and 257 are slidably coupled to an underside 211 of the seat member 212.

The adjustment members 256 and 257 are structurally and functionally similar. Accordingly, only adjustment member 256 will be illustrated and described in detail. As best illustrated in FIG. 13, adjustment member 256 includes a body portion 260, a handle portion 262, and extension portions 258.

Figure 9:
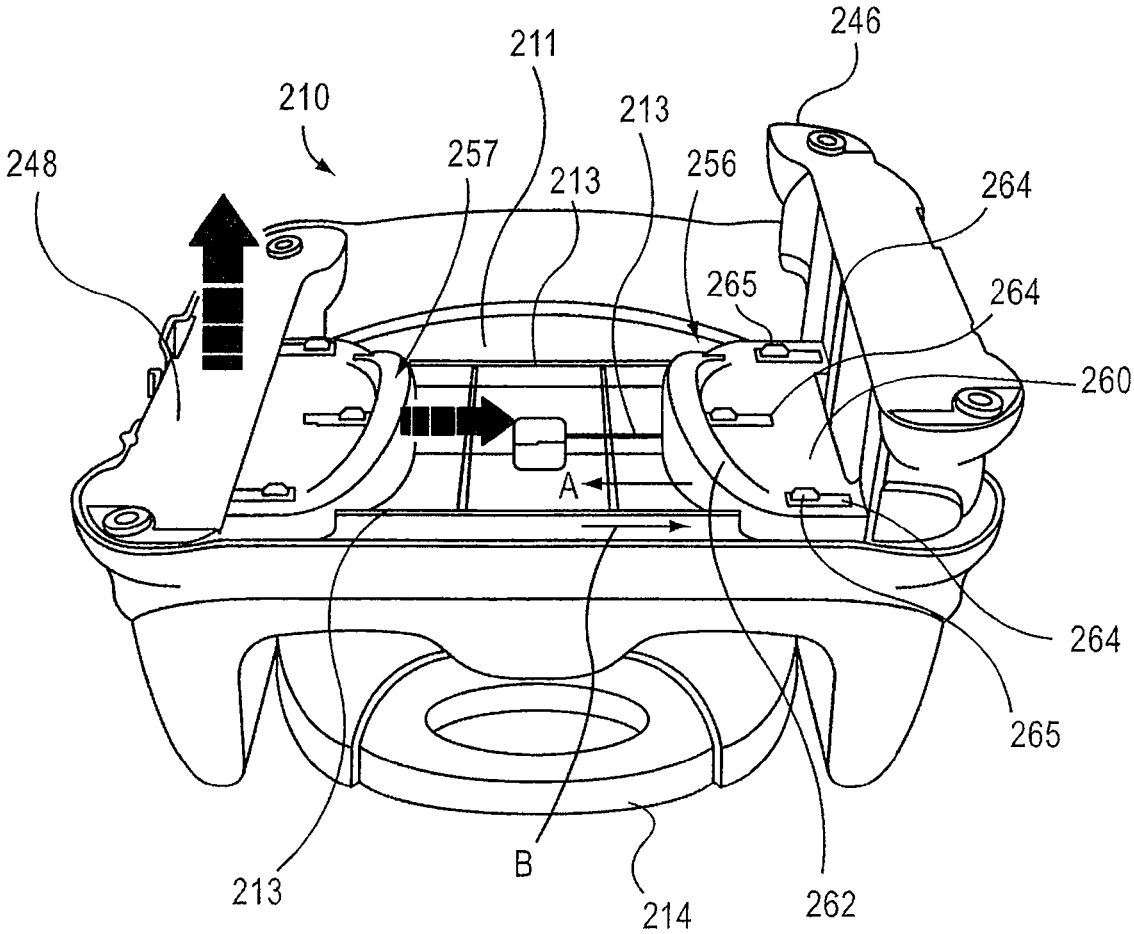
FIG. 9 is a bottom perspective view of the base member of FIG. 4.
Figure 10:
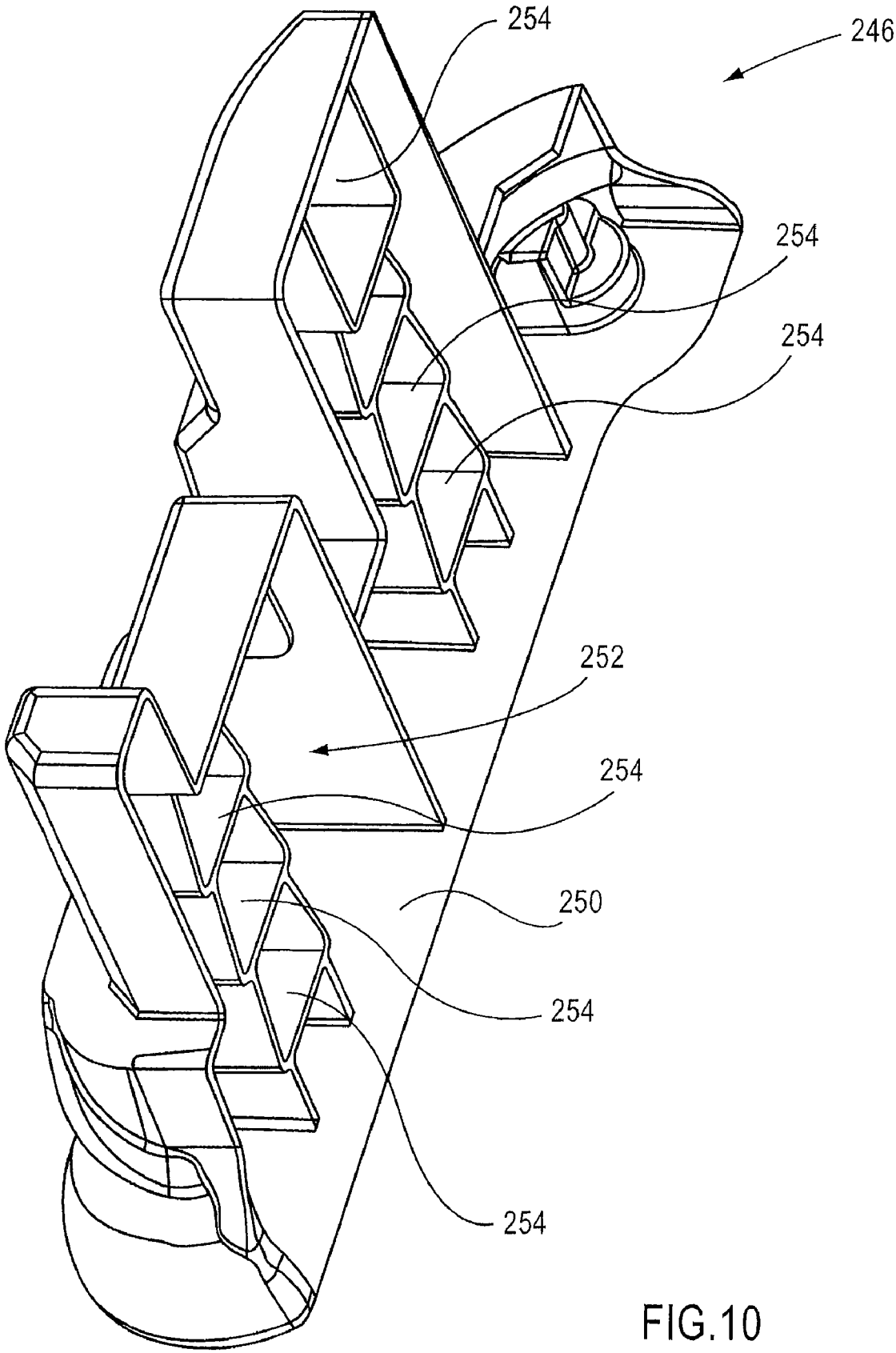
FIG. 10 is a perspective view of a leg portion of the base member of FIG. 4.
Figure 11:
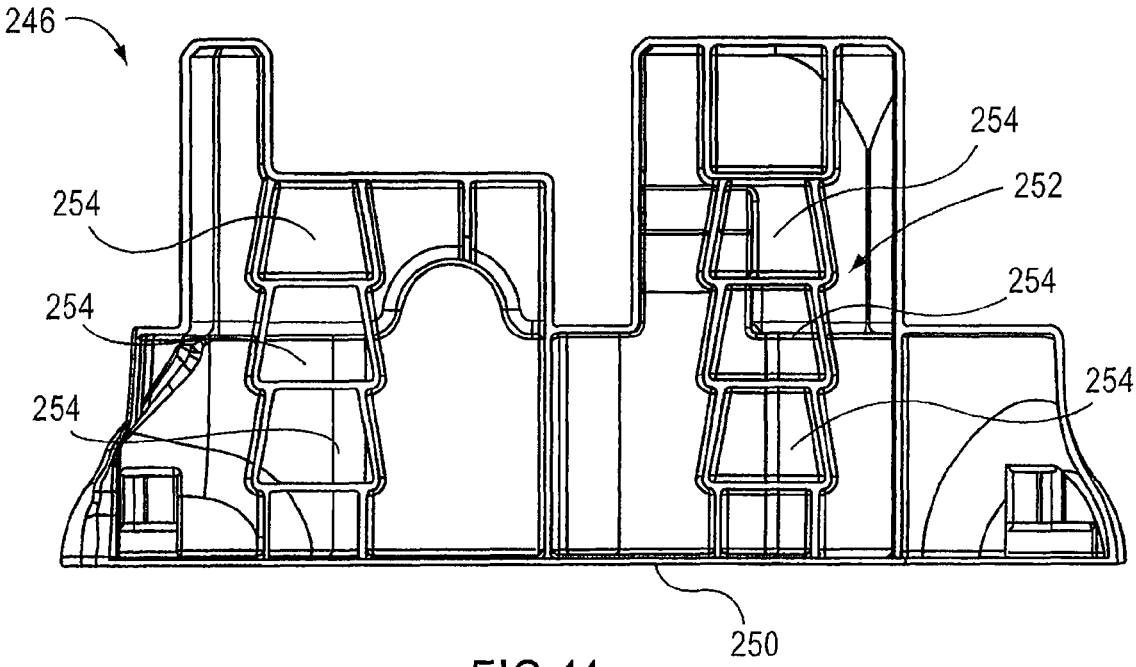
FIGS. 11 and 12 are side views of the leg portion of FIG. 10.
Figure 12:
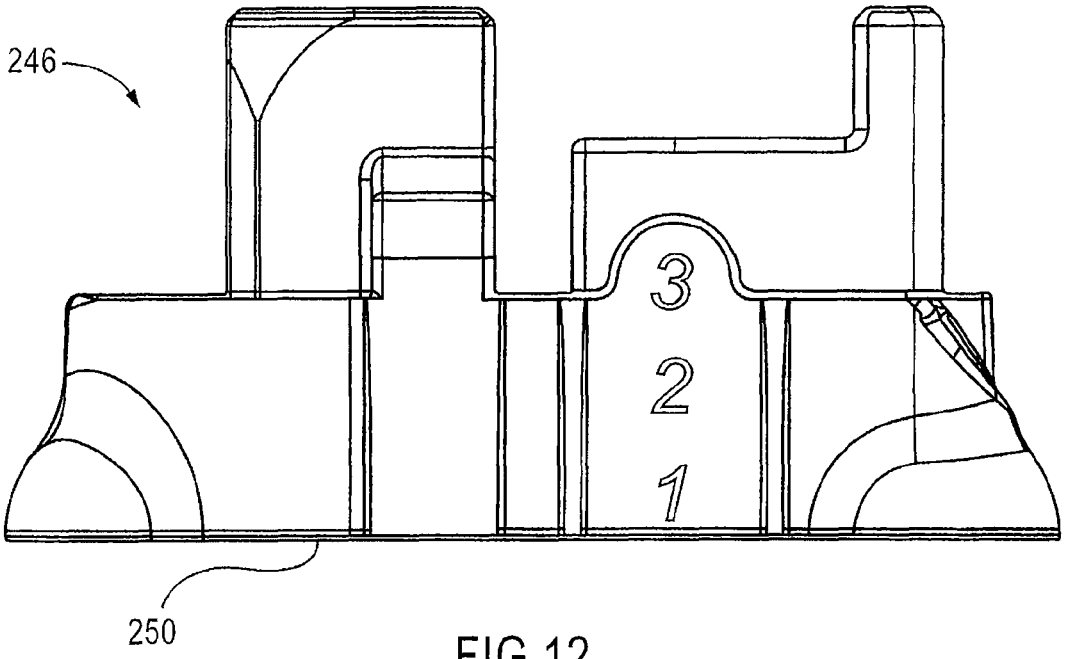

The adjustment member 256 also includes several slots 264. As best illustrated in FIG. 9, a fastener, such as a screw 265 extends though the slots 264 of the adjustment member 256 and are coupled to the underside 211 of the seat member 212. The fasteners 265 are configured to slide within the slots 264 of the adjustment member 256. Accordingly, the adjustment member 256 is slidably coupled to the underside 211 of the seat member 212 and is configured to slide with respect to the base member 210 in the directions indicated by arrows A and B. In the illustrated embodiment, the adjustment member 256 is biased, such as via a spring (not illustrated), into engagement with the leg portion 246 (i.e., in the direction of arrow A). In another embodiment, the adjustment member 256 is not biased in either the direction of arrow A or the direction of arrow B.

Figure 13:
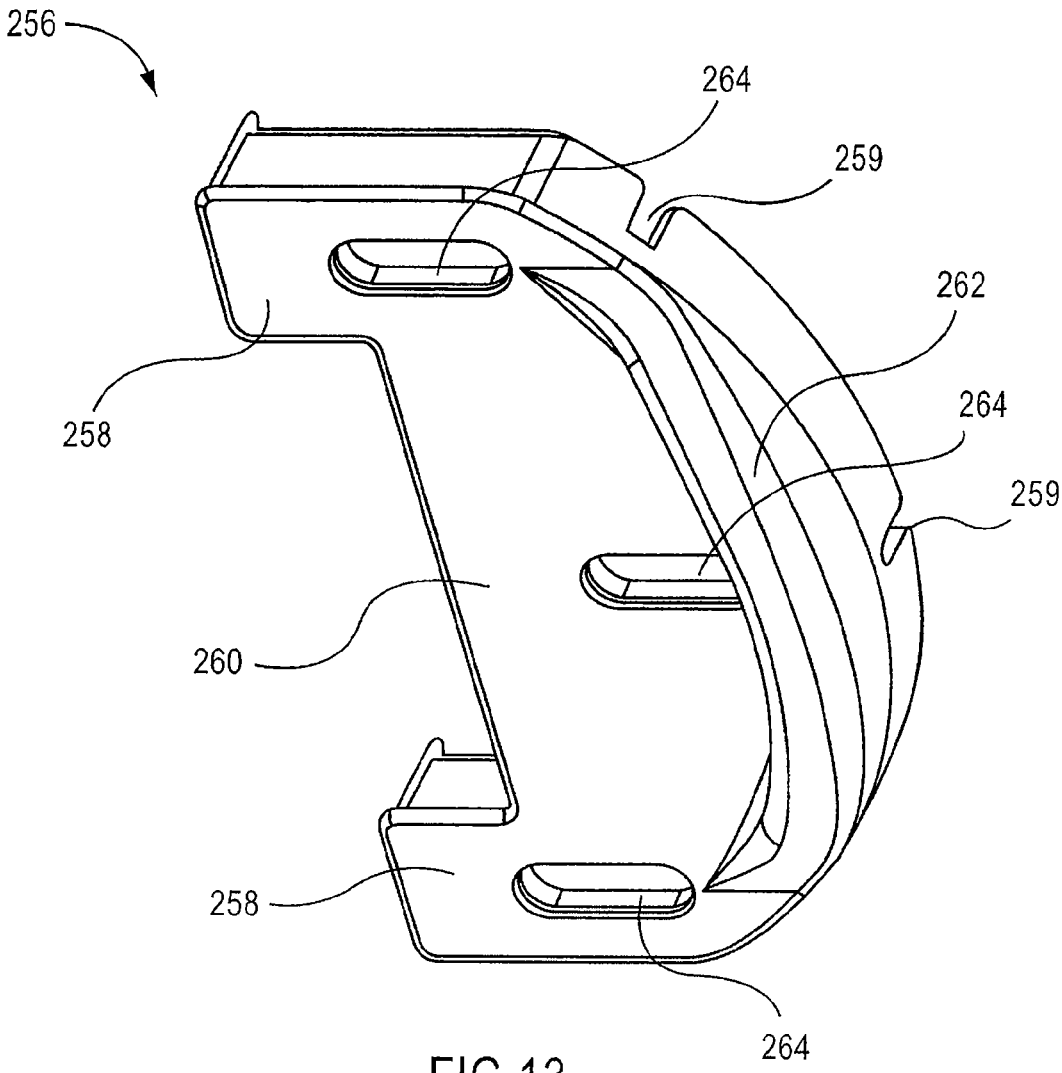
FIG. 13 is a perspective view of an adjustment member of the base member of FIG. 4.

In the illustrated embodiment, the adjustment member 256 includes multiple grooves 259 (only two are illustrated in FIG. 13). The grooves 259 are configured to receive and slide along ribs or rails 213 that are disposed on the underside 211 of the seat member 212. In an alternative embodiment, the adjustment member does not include grooves and the underside of the seat member does not include rails.

The leg portion 246 is slidably coupled to the base member 210 such that each of the extension portions 258 of the adjustment member 256 extend into and are received by a corresponding pair of receiving portions 254 of the leg portion 246 when the adjustment member 256 is moved in the direction of arrow A. A corresponding pair of receiving portions 254 is the pair of receiving portions 254 disposed an equal distance from the support portion 250 of the leg portion 246. The receipt of the extension portions 258 of the adjustment member 256 by the receiving portions 254 of the leg portion 246 secure or otherwise lock the leg portion 246 into position with respect to the base member 210.

Accordingly, the leg portion 246 may be placed in any one of its extended configuration, retracted configuration, or middle configuration. A user may grasp the handle portion 262 of the adjustment member 256 and apply a force on the adjustment member 256 in the direction of arrow A. When the force applied by the user overcomes the biasing force and any frictional force, the adjustment member 256 will be moved in the direction of arrow A with respect to the base member and the extension portions 258 of the adjustment member 256 will be withdrawn from the receiving portions 254 of the leg portion 246. The leg portion 246 may then slide with respect to the base member 210 and be positioned into another of its extended configuration, retracted configuration, or middle configuration. The user may then release the handle portion 262 of the adjustment member 256 thereby causing the adjustment member 256 to move in the direction of arrow B (via the spring biasing) and causing the extension portions 258 of the adjustment member 256 to be received by another corresponding pair of receiving portions 254 of the leg portion 246.

It should be understood that, in the illustrated embodiment, the interaction between adjustment member 257 and leg portion 248 is similar to the interaction between adjustment member 256 and leg portion 246 as described above. In an alternative embodiment, movement of one adjustment member 256 or 257 causes a corresponding movement in the other adjustment member 256 or 257.

In the illustrated embodiment, the child support 200 may be removably secured or coupled to a larger support structure such as a conventional chair. Specifically, the base member 210 includes attachment straps 227. Each of the attachment straps 227 are coupled at one end to the base member 210 and include one portion of a two portion coupling device, such as a buckle, a snap, or hook and loop material, coupled to another end of the attachment straps 227. Accordingly, each of the attachment straps 227 may be wrapped around a larger support structure, such as a conventional chair, and coupled to another attachment strap 227 via the coupling devices.

In another embodiment, the child support includes another coupling mechanism, such as suction cups or a latch mechanism, to removably couple the child support to a larger support structure. In yet another embodiment, the child support does not include attachment straps or any other device for coupling the child support to a larger support structure.

In the illustrated embodiment, an infant or child user may be secured on the seat portion 212 of the base member 210. Specifically, the child support 200 includes retaining straps 229. Each of the retaining straps 229 are coupled at one end to the base member 210 and include one portion of a two portion coupling device such as a buckle, a snap, or hook and loop material, coupled to another end of the retaining straps 229. Accordingly, each of the retaining straps 229 may be wrapped around an infant or child user and coupled to another retaining strap 229 via the coupling devices.

In another embodiment, the child support does not include retaining straps or any other device for securing a child or infant to the seat portion of the base member.

As best illustrated in FIGS. 15 through 24, the tray member 270 of the child support includes a first member 274, a second member 290, and a third member 310. The first member 274, the second member 290, and the third member 310 are configured to be stacked or otherwise placed on top of each other in a nesting configuration.

Figure 19:
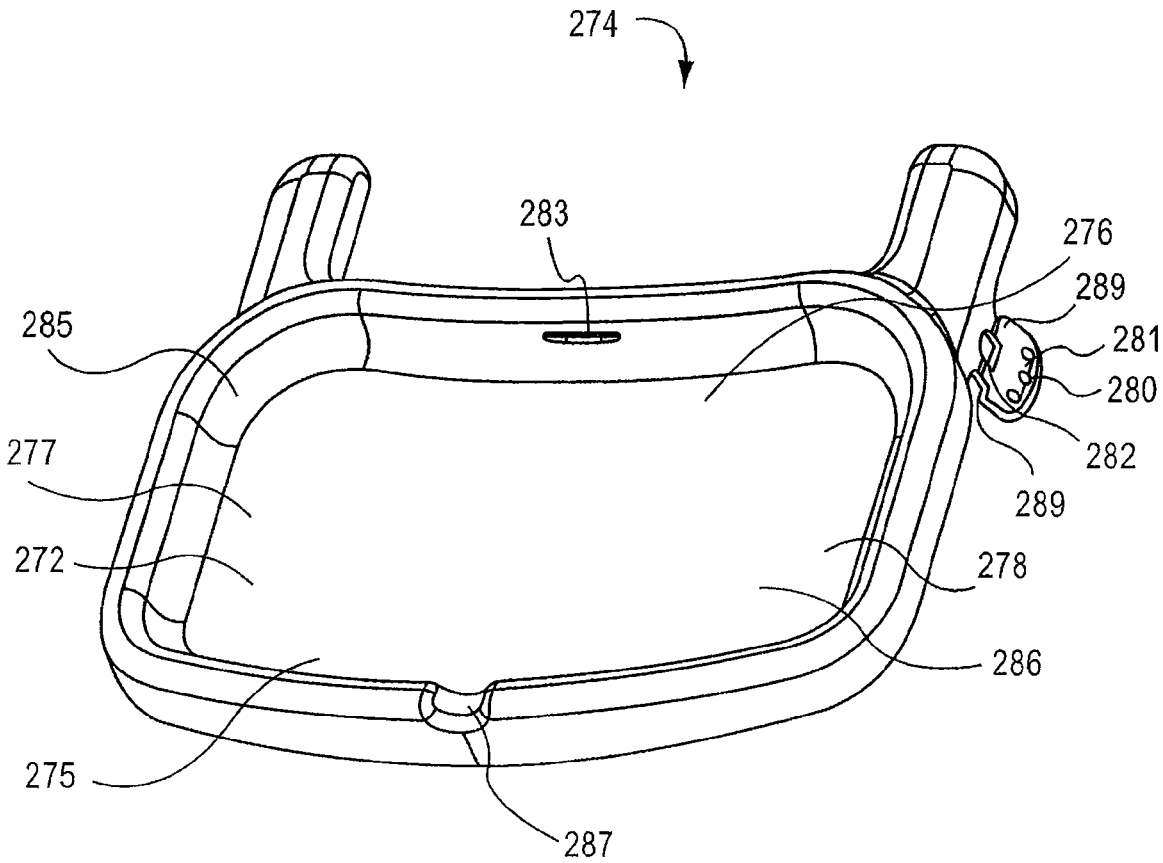
FIG. 19 is a perspective view of a first member of the tray member of FIG. 15.

As illustrated in FIG. 19, the first member 274 of the tray member 270 includes a front portion 275, a rear portion 276, a first side portion 277, and a second side portion 278. The first member 274 of the tray member 270 also includes a substantially continuous side wall 285 that extends from, and bounds the periphery of, a top surface 286 of the first member 274 of the tray member 270, defining a recess 272 in first member 274.

The first side portion 277 and the second side portion 278 of the first member 274 each include coupling members 279 and 280 respectively (only coupling member 280 is illustrated in FIG. 19). The coupling members 279 and 280 each include a flange portion 281 and an opening 282. Each of the openings 282 of the coupling members 279 and 280 is configured to receive one of the projections, for example, 230, 232, and 234, of the arm portions 216 and 218 of the base member 210 to removably couple the tray member 270 to the base member 210. Specifically, the coupling member 279 of the first side portion 277 of the first member 274 is configured to be removably coupled to arm portion 216 of the base member 210 and the coupling member 280 of the second side portion 278 of the first member 274 is configured to be removably coupled to arm portion 218 of the base member 274. In other words, the first member 274 of the tray member 270 is configured to be coupled to and extend between the arm portions 216 and 218 of the base member 210 when the first member 274 of the tray member 270 is coupled to the base member 210.

The resilient flange portions 281 of the coupling members 279 and 280 include edges 289 that are configured to abut the projections, for example 230, 232, and 234, of the arm portions 216 and 218 of the base member 210 that are immediately adjacent to the projection 230, 232, and 234 of the base member 210 that is received by the openings 282 of the coupling members 279 and 280.

The tray member 270 is removable from the base member 210. Specifically, the resilient flange portions 281 of the coupling members 279 and 280 are configured to be bent or otherwise flexed by a user to remove the projections, for example 230, 232, and 234 of the arm portions 216 and 218 of the base member 210 from the openings 282 of the coupling members 279 and 280. In the illustrated embodiment, each of the arm portions 214 and 216 of the base member 210 include three projections. Thus, the tray member 270 may be removably coupled to the arm portions 216 and 218 in one of three different positions to allow the child support 200 to be used by different sized children or infants. Depending upon the position of the tray member 270, a different projection 230, 232 and 234 will be positioned in the opening 282. In alternative embodiments, the projections are on the coupling members 279 and 280 and the openings are on the support arms 216 and 218.

Figure 18:
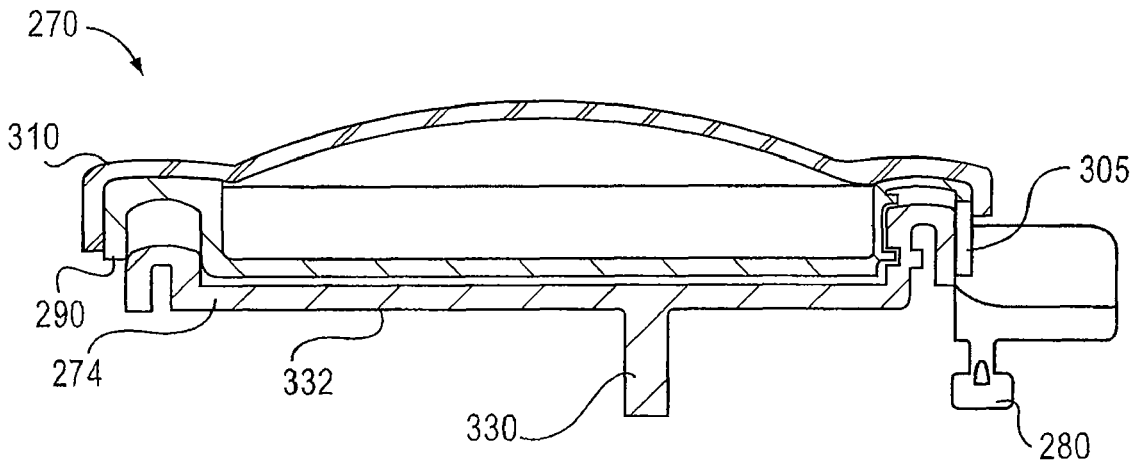
FIG. 18 is a cross-sectional view of the tray member of FIG. 15 taken along line 18-18 of FIG. 17.

As best illustrated in FIG. 18, in the illustrated embodiment, the first member 274 of the tray 270 includes a retention member 330. The retention member 330 extends from a lower surface 332 of the first member 274 of the tray 270. The retention member 330 is configured to retain a child seated on the base member 210 when the tray 270 is coupled to the arm portions 216 and 218 in a first position. The retention member 330 is configured to be disposed within the recess 217 defined by the perimeter wall 219 of the back portion 214 when the tray 270 is coupled to the arm portions 216 and 218 in a second position opposite the first position as shown in FIGS. 25 and 26. When the tray member 270 is coupled to the base member 210, the retention member 330 is disposed such that a leg of a child of infant seated on the base member 210 is on each side of the retention member 330. Accordingly, the retention member 330 is configured to retain a child or infant on the base member 210. In an alternative embodiment, the first member does not include a retention member. In another alternative embodiment, the retention member is coupled to the seat 212.

The rear portion 276 of the first member 274 of the tray member 270 includes an opening 283. Additionally, the side wall 285 of the first member 274 includes a U-shaped depression 287. As will be discussed in detail below, the opening 283 is configured to receive a portion of the second member 290 of the tray member 270 to removably couple the second member 290 of the tray member 270 to the first member 274 of the tray member 270 and the U-shaped depression 287 is configured to allow a user to grasp the second member 290 of the tray member 270 when the second member 290 is coupled to the first member 274.

Figure 20:
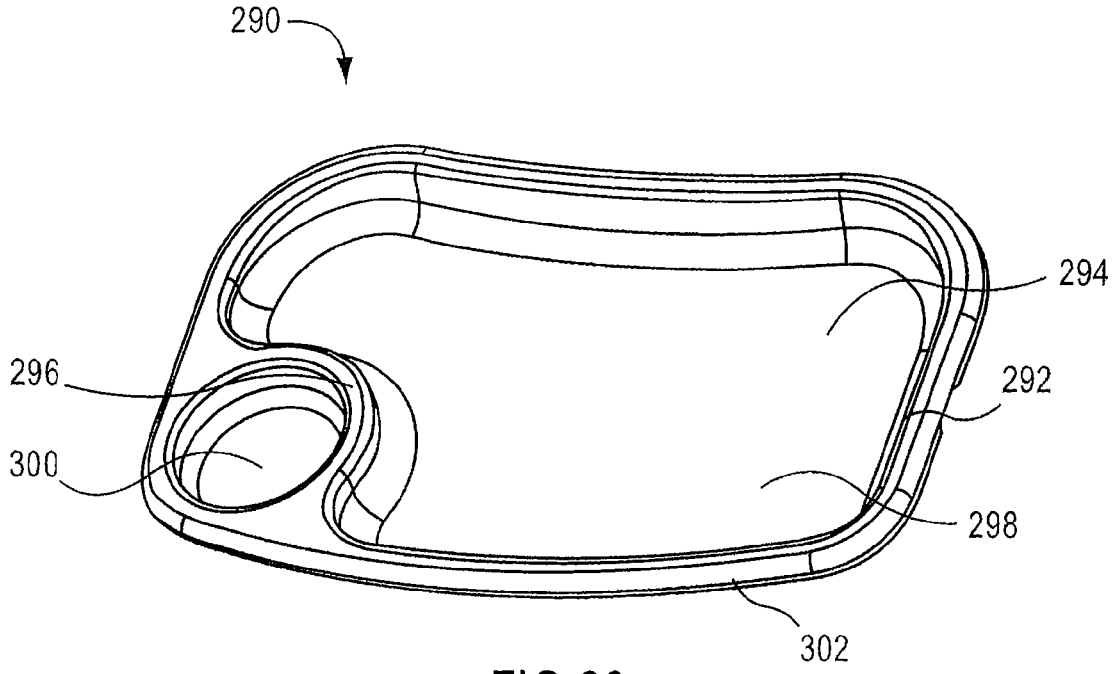
FIG. 20 is a perspective view of a second member of the tray member of FIG. 15.
Figure 21:
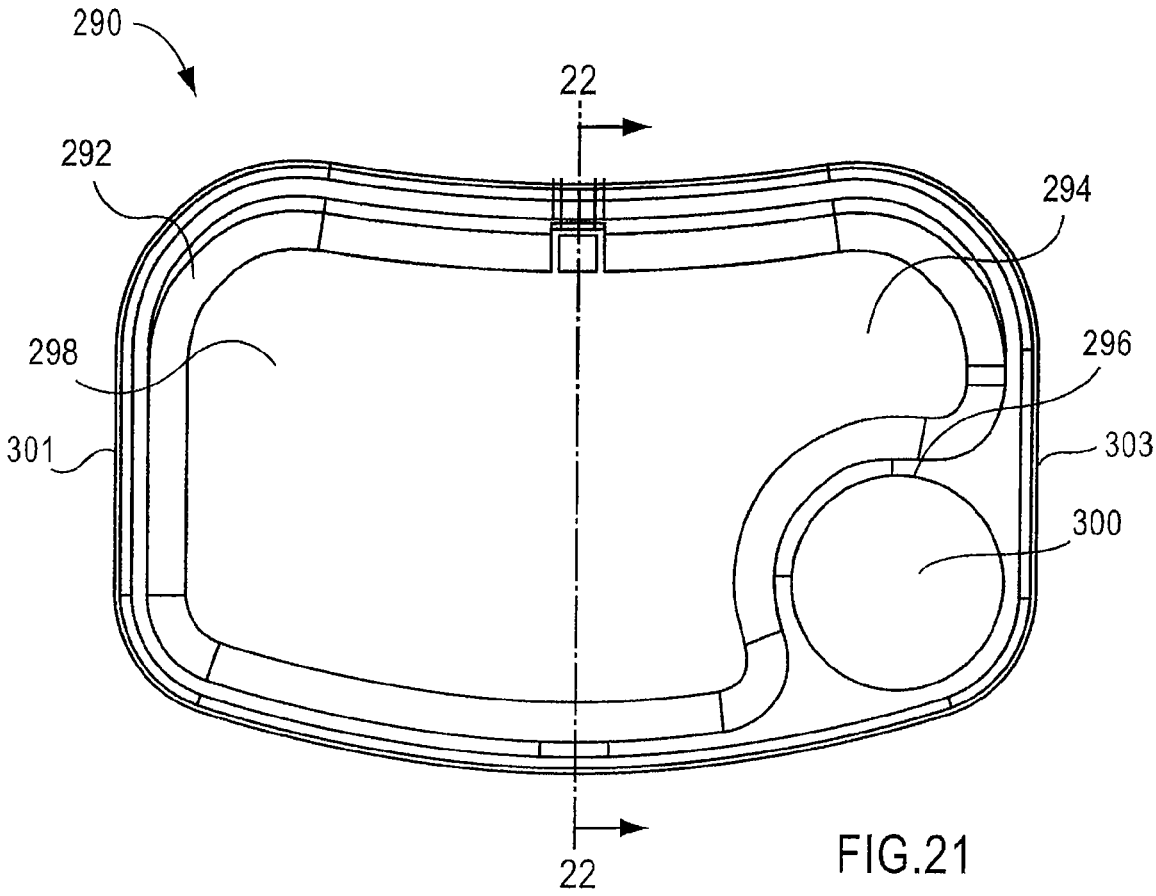
FIG. 21 is a top view of the second member of FIG. 20.
Figure 22:
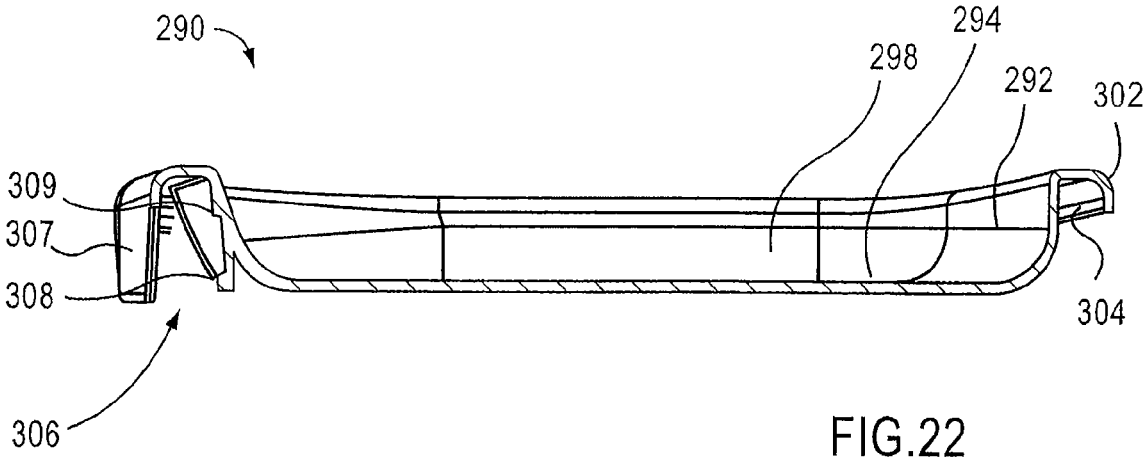
FIG. 22 is a cross-sectional view of the second member of FIG. 20 taken along line 22-22 of FIG. 21.

As illustrated in FIGS. 20 through 22, the second member 290 of the tray member 270 includes a first wall 292 that extends from a top surface 294 of the second member 290 and a second wall 296 that extends from the top surface 294 of the second member 290. The first wall 292 of the second member 290 defines with top surface 294 a first receiving portion or recess 298 that is configured to received and support items such as food items. The second wall 296 defines a second receiving portion or recess 300 that is configured to receive items such as a cup or bottle. In the illustrated embodiment, the second member 290 of the tray member 270 is sized such that it will fit within a conventional dishwasher and is made of a dishwasher safe material such as, for example, propylene, polycarbonate, polystyrene, polyethylene, or acrylonitrile butadiene styrene, which will not deform or significantly degrade under temperature conditions typically found in a conventional household or commercial automatic dishwashing machine. In an alternative embodiment, the second member 290 is made of a flexible material such as a thermoplastic elastomer (TPE).

Although the second member 290 of the tray member 270 is illustrated and described as having walls 292 and 296 that extend from and define different sized receiving portions, it is not necessary that the second member 290 have such walls 292 and 294. In an alternative embodiment, the second member has a single receiving portion or recess that is configured to support items such as food items and beverages. In a further alternative embodiment, the second member of the tray member is not sized to fit within a conventional dishwasher. In yet a further alternative embodiment, the second member of the tray member is not made of a dishwasher safe material.

In the illustrated embodiment, the second member 290 of the tray member 270 includes an edge 302 that extends around the perimeter of the second member 290 and defines a channel 304 that similarly extends around the perimeter of the second member 290. The second member 290 of the tray member 270 also includes a coupling portion 306 that extends within the channel 304 of the second member 290. The coupling portion includes engagement members such as projections or tabs 308 and 309 that are disposed a distance from each other.

The channel 304 is configured to receive a portion of the side wall 285 of the first member 274 of the tray member 270 when the second member 290 of the tray member 270 is placed on top of the first member 274 of the tray member 270. Additionally, the coupling portion 306 of the second member 290 is configured to removably couple the second member 290 to the first member 274 when the second member 290 is placed on top of the first member 274 of the tray member 270. Specifically, the projection 308 is configured to extend within the opening 283 of the first member 274. Additionally, the projection 309 is configured to cooperate with a portion of the side wall 285 of the first member 274. Accordingly, the coupling portion 306 grips or otherwise retains a portion of the first member 274 to removably couple the second member 290 of the tray member 270 to the first member 274 of the tray member 270.

In the illustrated embodiment, the second member 290 of the tray member 270 includes extension members 305 and 307 (best seen in FIGS. 18, 22 and 26). The extension members 305 and 307 extend from the edge 302 of the second member 290 proximate the coupling portion 306. The extension members 305 and 307 are configured to cooperate with a portion of the first member 274 of the tray member 270 to retain the projection 308 of the coupling portion 306 within the opening 283 of the first member 274. As illustrated in FIG. 26, the extension members 305 and 307 nest within a recess 273 of the first member 274.

The extended members 305 and 307 are configured to flex such that when a user lifts the second member 290 with respect the first member 274 proximate the front portion 275 of the first member 274, the extended member 305 and 307 flex to allow the projection 308 to be removed from the opening 283. In one embodiment, the extension members 305 and 307 cooperate with a portion of the first member 274 of the tray member 270 to retain the projection 308 within the opening 283 such that a user cannot remove the second member 290 from the first member 274 by lifting the second member 290 with respect to the first member 274 proximate the rear portion 276 of the first member 274. Additionally, in one embodiment, the extension members 305 and 307 cooperate with a portion of the first member 274 of the tray member 270 to grip or grasp a portion of the first member 274.

In an alternative embodiment, the second member 290 includes a single extension member. In a further alternative embodiment, the second member 290 does not include an extension member.

The coupling portion 306 of the second member 290 is configured to flex or bend. Accordingly, to remove the second member 290 from the first member 274, the second member is lifted with respect to the first member 274. Specifically, a user can place a finger in the space defined by the U-shaped depression 287 of the first member 274 and grasp the second member 290 of the tray member 270. The user can then lift the second member 290 with respect to the first member 274 thereby causing the coupling portion 306 to flex or bend such that the projection 308 is removed from the opening 283 of the first member 274.

The second member 290 of the tray member 270 also includes coupling portions or grooves 301 and 303. As will be discussed below, the coupling portions or grooves 301 and 303 of the second member 290 are configured to cooperate with projections 316 and 318 of the third member 310 of the tray member 270 to removably couple the third member 310 to the second member 290.

Figure 23:
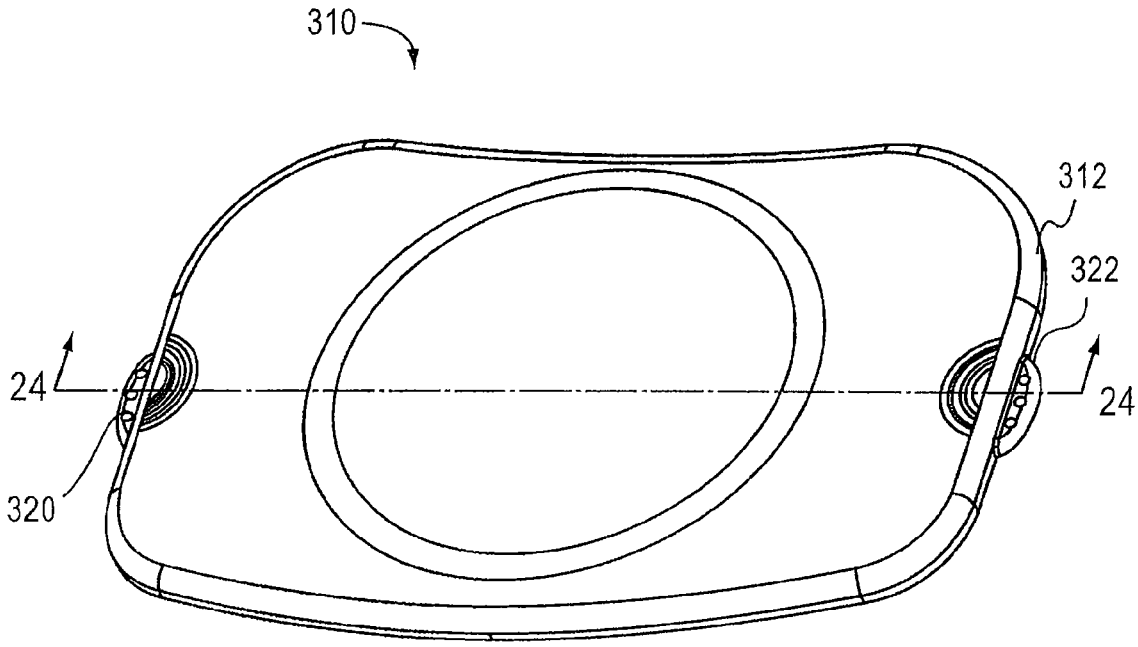
FIG. 23 is a perspective view of a third member of the tray member of FIG. 15.
Figure 24:
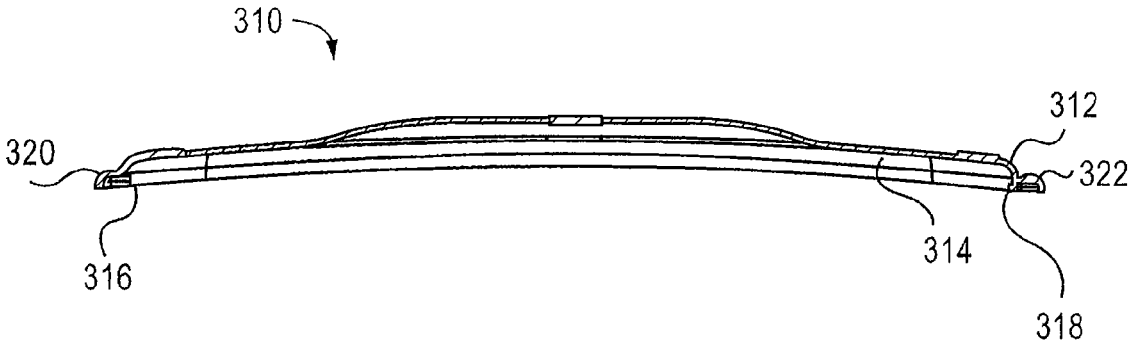
FIG. 24 is a cross-sectional view of the third member of FIG. 23 taken along line 24-24 of FIG. 23.

As illustrated in FIGS. 23 and 24, the third member 310 of the tray member 270 includes a side wall 312 that extends downwardly from a bottom surface 314 of the third member 310. The third member 310 also includes projections 316 and 318 that extend inwardly from the side wall 312. The projections 316 and 318 are configured to cooperate with the coupling portions or grooves 301 and 303 of the second member 290 of the tray member 270, respectively to removably couple the third member 310 to the second member 290.

In one embodiment, the side wall 312 of the third member 310 of the tray member 270 abuts the second member 290 of the tray member 270 when the third member 310 is coupled to the second member 290. In other words, a seal is formed between the second member 290 and the third member 310 when the third member 310 is coupled to the second member 270.

In the illustrated embodiment, when the third member 310 of the tray member 270 is coupled to the second member 290 of the tray member 270, a space is disposed between the top surface 294 of the second member 290 and the bottom surface 314 of the third member 310. In other words, when the third member 310 is coupled to the second member 290, the top surface 294 of the second member 290 and the bottom surface 314 of the third member 310 define a cavity.

Thus, when an object or an item such as food is disposed on the top surface 294 of the second member 290 and the third member 310 is coupled to the second member 290, the item is sealed, trapped, or otherwise retained within the cavity between the second member 290 and the third member 310. Although the tray 270 is described primarily as having three tray members, in some alternative embodiments, the tray may include only two members. For example, in such an embodiment, the first tray member and another tray member are removably coupled together to define a cavity between the first tray member and the other tray member.

In the illustrated embodiment, the third member 310 of the tray member 270 includes handle portions 320 and 322. The third member 310, including the projections 316 and 318, is configured to flex or bend. Accordingly, to remove the third member 310 from the second member 290 a user may grasp the handle portions 320 and 322 and may flex or bend the third member 310 such that the projections 316 and 318 are removed from their cooperating relationship with the coupling portion or grooves 301 and 303 of the second member 290.

In an alternative embodiment, the third member does not include handle portions. Rather, a user may grasp the third member along the perimeter of the third member and may flex the third member to remove the third member from the second member. In a further alternative embodiment, the entire third member is not configured to flex or bend. Rather, only a portion of the third member, for example a portion proximate one of the projections is configured to flex or bend to allow the projection to be removed from its cooperating relationship with the coupling portion or groove of the second member.

In an alternative embodiment, the third tray member and the other tray member to which it is coupled can be coupled by a tongue-in-groove arrangement (e.g., a Tupperware® type of connection). In other words, the various tray members may be coupled completely around their perimeters or around only a portion of their perimeters.

Although in the illustrated embodiment, the second member 290 of the tray member 270 is illustrated and described as being removably coupled to the first member 274 and the third member 310 is illustrated and described as being removably coupled to the second member 290, the members 274, 290, and 310 need not be configured as such. For example, in an alternative embodiment, the third member of the tray member may be removably coupled to the first member such that the second member is disposed between the first and the second member.

Additionally, although in the illustrated embodiment, the first member of the tray member is configured to be coupled directly to the base member, the first member need not be configured to be coupled directly to the base member. In an alternative embodiment, another member of the tray member is configured to be directly coupled to the base member.

As illustrated in FIGS. 25 and 26, the child support 200 may be placed in a collapsed or storage configuration. In this configuration, the back portion 214 of the base member 210 is in its parallel configuration and the tray member 270 is coupled to the base member such that the back portion 214 is disposed between the tray member 270 and the seat member 212. In the illustrated embodiment, the tray member 270 may be coupled to the base member 210 in a reverse configuration. In other words, the tray member 270 may be rotated 180 degrees from its use position prior to coupling the tray member 270 to the base member 210 to place the child support 200 in its collapsed configuration. In addition, when the child support 200 is in its collapsed configuration, the leg members 246 and 248 are placed in their retracted configuration. As illustrated in FIG. 25, when the child support 200 is in the collapsed configuration, straps 227 can be coupled over the tray member 270. The free end 350 of strap 227 can be pulled in the direction of arrow A and then secured to itself via a conventional fastener as indicated by arrow B.

Figure 27:
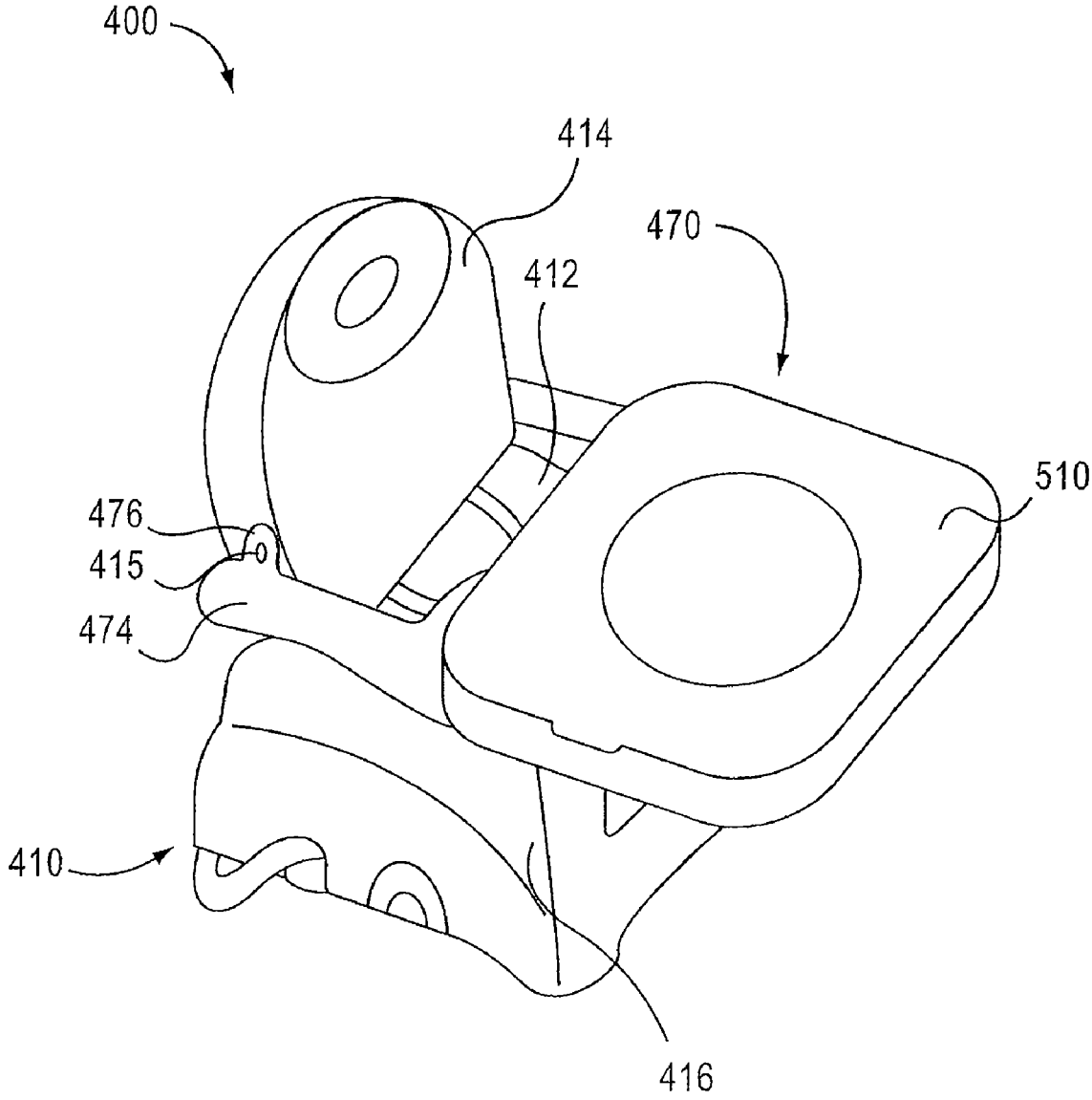
FIG. 27 is a perspective view of an embodiment of a child support in accordance with the invention.

FIG. 27 illustrates a child support in accordance with another embodiment of the invention. The child support 400 includes a base member 410 that has a back portion 414, arm portions 416 (only one arm portion is visible in FIG. 26), and a seat portion 412. In one embodiment, the back portion 414 and the arm portions 416 are upright members and extend upwardly from the seat portion 412 of the base member 410.

The child support 400 also includes a tray member 470 that is removably coupled to the base member 410. Specifically, the tray member 470 includes a first member 474, a second member (not visible in FIG. 26), and third member 510. The second member of the tray member 470 is configured to be coupled between the first member 474 and the third member 510.

In the illustrated embodiment, the first member 474 of the tray member 470 includes a coupling portion 476 that is configured to cooperate with a coupling portion 415 of the back portion 414 of the base member 410 to removably couple the tray portion 470 to the base member 410.

In one embodiment, the coupling portion 476 of the first member 474 includes an opening and the coupling portion 415 of the back portion 414 includes a projection. The opening of the coupling portion 476 is configured to receive the projection of the back portion 414 to removably couple the first member 474 to the back portion 414. In an alternative embodiment, the coupling portion 476 of the first member 474 includes a projection and the coupling portion 415 of the back portion 414 includes an opening configured to receive the projection.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents. For example, any type of coupling mechanism may be used to couple the tray member to the base member. Additionally, any type of coupling mechanism may be used to coupled the various members of the tray member together.

What is claimed is:

1. An apparatus for supporting an infant, the apparatus comprising:

a base member including:

a seat portion having a top surface and a bottom surface, and an upright portion extending upward from the top surface of the seat portion, wherein the top surface of the seat portion and the upright portion cooperate to define a seating area;

a tray configured to be removably coupled to the upright portion of the base member;

a first leg repositionable with respect to the base member, the first leg comprising:

a support portion configured to support the base member on a support surface, and an adjustment portion extending upward from the support portion, wherein the first leg is slidably coupled to the base member such that the first leg selectively moves from a retracted first leg position, in which the adjustment portion of the first leg is received within the upright portion of the base member, to an extended second leg position, in which the adjustment portion of the second leg extends downward from the base member; and a second leg repositionable with respect to the base member, the second leg comprising:

a support portion configured to support the base member on a support surface, and an adjustment portion extending upward from the support portion, wherein the second leg is slidably coupled to the base member such that the second leg selectively moves from a retracted second leg position, in which the adjustment portion of the second leg is received within the upright portion of the base member, to an extended second leg position, in which the adjustment portion of the second leg extends downward from the base member; and an adjustment member slidably coupled to the base member, the adjustment member being positioned directly below the seat portion and oriented between the first leg and the second leg, and wherein the adjustment member is configured to secure the first leg in at least one of the retracted first leg position and the extended first leg position, wherein the first leg is repositionable independently of the second leg.

2. The apparatus of claim 1, wherein:

the adjustment portion of the first leg comprises a plurality of receptacles; and the adjustment member comprises:

a body portion, and an extension portion extending distally from the body portion, wherein the extension portion selectively mates with one of the plurality of receptacles on the adjustment portion of the first leg.

3. The apparatus of claim 1, wherein the tray includes a first tray member configured to be removably coupled to the upright member, a second tray member configured to be removably coupled to the first tray member, and a third tray member configured to be removably coupled to the second tray member.

4. The apparatus of claim 1, wherein the adjustment member is configured to move along an axis perpendicular to an axis along which the first leg is configured to move.

5. The apparatus of claim 1, wherein:

in the retracted first leg position, the adjustment portion of the first leg extends into an area of the upright portion oriented above the seating surface of the seat portion; and in the retracted second leg position, the adjustment portion of the second leg extends into an area of the upright portion oriented above the seating surface of the seat portion.

6. The apparatus of claim 1, wherein the base member comprises:

a first leg receptacle operable to axially receive the first leg; and a second leg receptacle operable to axially receive the second leg.

7. The apparatus of claim 6, wherein:

the adjustment portion of each leg comprises a plurality of cavities;

the adjustment member comprises a first adjustment member disposed proximate the first leg and a second adjustment member disposed proximate the second leg; and each of the first and second adjustment members includes an extension portion operable to selectively engage the cavities of a corresponding leg adjustment portion.

8. The apparatus of claim 7, wherein each of the first and second adjustment members is biased into engagement with its corresponding leg.

9. The apparatus of claim 1 further comprising attachment straps connected to the base, the straps operable to secure the apparatus for supporting an infant to a larger support structure.

10. The apparatus of claim 1 further comprising a tray member including:

a first tray operable to couple to the base; and a second tray operable to couple to the first tray.

11. The apparatus of claim 10, wherein:

the first tray comprises:

an upper tray surface and a lower tray surface, and a retention member extending from a lower tray surface, the retention member operable to retain a child seated on the seating area of the base member when the first tray is coupled to the base member; and the second tray is positioned over the upper tray surface.

12. A booster seat for an infant comprising:

a base comprising:

a seating surface and a support-facing surface, the support-facing surface being oriented towards a support surface, and a first arm support portion configured to support an arm, the first arm support portion extending upward from the seating surface, a second arm support portion configured to support an arm, the second arm support portion extending upward from the seating surface;

a first telescoping leg operable to support the base on the support surface, wherein the first telescoping leg is configured to selectively retract into and extend out of the base;

a second telescoping leg operable to support the base on the support surface, wherein the second telescoping leg is configured to selectively retract into and extend out of the base; and an adjustment member coupled to the support-facing surface of the base, wherein the adjustment member is configured to selectively engage the first telescoping leg to lock the first telescoping leg into position with respect to the base, wherein the base further comprises;

a first leg receptacle defined by the first arm support portion, wherein the first leg receptacle is configured to telescopingly receive the first telescoping leg, and a second leg receptacle defined by the second arm support portion, wherein the second leg receptacle is configured to telescopingly receive the second telescoping leg, and wherein the first telescoping leg telescopes into and out of the base independently of the second telescoping leg.

13. The booster seat of claim 12, wherein:

each telescoping leg comprises:

a support portion configured to contact the support surface, and an adjustment portion extending distally from the support portion;

the base further comprises:

a first opening formed into the support-facing surface, the first opening being aligned with the first arm support portion and configured to permit passage of an adjustment portion therethrough, and a second opening formed into the support-facing surface, the second opening being aligned with the second arm support portion and configured to permit passage of an adjustment portion therethrough.

14. The booster seat of claim 13, wherein the adjustment portion comprises a plurality of cavities.

15. The booster seat of claim 14, wherein:

the adjustment member comprises a first adjustment member disposed between the first telescoping leg and the second telescoping leg, the first adjustment member being configured to move along the support-facing surface of the base and to selectively engage at least one of the cavities of the adjustment portion of the first telescoping leg; and the base further includes a second adjustment member coupled to the support-facing surface of the base and disposed between the first telescoping leg and the second telescoping leg, the second adjustment member being configured to selectively engage the second telescoping leg to lock the second telescoping leg into a position with respect to the base, wherein the second adjustment member is configured to move along the support-facing surface of the base and to selectively engage at least one of the cavities of the adjustment portion of the second telescoping leg.

16. The booster seat of claim 15, wherein each adjustment member comprises:

an extension portion operable to selectively engage at least one of the cavities of a corresponding leg; and a plurality of slots, each slot including a fastener configured to slide within the slot, the fasteners coupling the adjustment member to the base.

17. The booster seat of claim 16, wherein the first and second adjustment members are each biased into engagement with its corresponding leg.

18. The booster seat of claim 13, wherein:

the adjustment member comprises a first adjustment member disposed directly below the seating surface;

the booster seat further includes a second adjustment member coupled to the support-facing surface of the base and disposed directly below the seating surface; and the second adjustment member is configured to selectively engage the second telescoping leg to lock the second telescoping leg into a position with respect to the base.

19. The booster seat of claim 12, wherein:

each leg receptacle comprises a channel formed into the base; and each leg moves from a first, retracted position, in which the adjustment portion is completely inserted into a corresponding leg receptacle, to a second, extended position, in which the adjustment portion partially extends from the corresponding leg receptacle.

20. The booster seat of claim 12 further comprising attachment straps connected to the base, wherein the straps are configured to secure the booster seat to a support structure.

21. The booster seat of claim 12 further comprising a tray assembly including:

a first tray operable to couple to the arm support portions of the base; and a second tray operable to couple to the first tray.

22. The booster seat of claim 21, wherein:

the first tray comprises:

an upper surface and a lower surface, and a retention member extending from a lower surface of the tray, the retention member operable to retain a child seated on the seating surface of the base when the first the first tray is coupled to the base; and the second tray is positioned over the upper surface of the first tray.

23. The booster seat of claim 22, wherein:

the first tray comprises:

a peripheral side wall defining a central recess, and an opening formed into the side wall; and the second tray comprises:

a perimeter wall defining a receiving area, and a tab extending from the perimeter wall, the tab configured to mate with the opening in the side wall on the first tray.

24. The booster seat of claim 23, wherein the peripheral side wall of the first tray further comprises a U-shaped depression configured to allow a user to grasp the second tray.

25. The booster seat of claim 12, wherein:

the base further comprises a backrest portion extending above the seating surface and disposed between the arm support portions; and the first arm support portion is defined by a first wall disposed along a first lateral side of the base;

the second arm support portion is defined by a first wall disposed along a second lateral side of the base.

26. A booster seat for an infant comprising:

a base defining a seating surface and a support-facing surface opposite the seating surface, the support-facing surface being oriented towards a support surface;

a first telescoping leg movably coupled to the base, the first telescoping leg comprising:

a support portion configured to contact the support surface, and an adjustment portion comprising a plurality of cavities, the adjustment portion extending distally from the support portion, wherein the first telescoping leg is configured to telescope into and out of the base;

a second telescoping leg movably coupled to the base, the second telescoping leg comprising:

a support portion configured to contact the support surface, and an adjustment portion comprising a plurality of cavities, the adjustment portion extending distally from the support portion, wherein the second telescoping leg is configured to telescope into and out of the base independently of the first telescoping leg;

a first adjustment member slidably coupled to the support-facing surface of the base such that the first adjustment member moves along the support-facing surface of the base, the first adjustment member including an extension portion operable to selectively engage at least one of the cavities of the first telescoping leg to lock the first telescoping leg into a position with respect to the base; and a second adjustment member slidably coupled to the support facing surface of the base such that the second adjustment member moves along the support-facing surface of the base, the second adjustment member including an extension portion operable to selectively engage at least one of the cavities of the second telescoping leg to lock the second telescoping leg into a position with respect to the base, wherein each adjustment member further comprises a plurality of slots, each slot including a fastener configured to slide within the slot, the fasteners coupling the adjustment member to the base, and wherein the first and second adjustment members are each biased into engagement with its corresponding leg.

27. The booster seat of claim 26, wherein:

the base comprises a first leg receptacle and a second leg receptacle, each receptacle comprising an open channel formed into the base;

the first telescoping leg telescopes into and out of the first leg receptacle such that the adjustment portion of the first telescoping leg is selectively housed within the first leg receptacle; and the second telescoping leg telescopes into and out of the second leg receptacle such that the adjustment portion of the second telescoping leg is selectively housed within the second leg receptacle.

28. A booster seat for an infant comprising:

a seat member configured to support an infant, the seat member defining a seating surface and a support-facing surface, the support-facing surface being oriented towards a support surface;

a first telescoping leg operable to telescope into and out of the seat member to selectively raise and lower the seat member with respect to the support surface;

a second telescoping leg operable to telescope into and out of the seat member to selectively raise and lower the seat member with respect to the support surface;

a backrest;

a first arm extending distally from the seating surface of the seat member, the first arm defining an first arm support surface oriented above the seating surface;

a second arm extending distally from the seating surface of the seat member, the second arm defining a second arm support surface oriented above the seating surface; and at least one adjustment member coupled to the support-facing surface of the seat member and configured to secure the first and second telescoping legs when telescoping into and out of the seat member, wherein the first telescoping leg telescopes into and out of the seat member independently of the second telescoping leg.

29. The booster seat of claim 28, wherein:

the support-facing surface of the seat member comprises a first opening aligned with the first arm and a second opening aligned with the second arm;

the first telescoping leg extends into the seat member via the first opening; and the second telescoping leg extends into the seat member via the second opening.

30. The booster seat of claim 29, wherein:

each arm remains stationary while each leg telescopes into and out of the seat member; and the booster seat further comprises a tray assembly that removably connects to the arms of the booster seat.

31. The booster seat of claim 28, wherein:

each telescoping leg comprises:

a support portion configured to contact the support surface, and an adjustment portion extending distally from the support portion, the adjustment portion having a proximal portion and a distal portion;

the first arm defines a first leg receptacle operable to receive the first telescoping leg; and the second arm defines a second leg receptacle operable to receive the second telescoping leg; and each telescoping leg moves from a first leg position, in which the telescoping leg extends outward from the seat member via an opening formed in the seat member, to a second leg position, in which the telescoping leg is retracted into the seat member such that the distal portion of the adjustment portion is oriented above the seating surface.

* * * * *